US006399268B1

(12) United States Patent
Fleming et al.

(10) Patent No.: US 6,399,268 B1
(45) Date of Patent: Jun. 4, 2002

(54) PROCESSLESS DIRECT WRITE IMAGING MEMBER CONTAINING POLYMER GRAFTED CARBON AND METHODS OF IMAGING AND PRINTING

(75) Inventors: James C. Fleming, Webster; Jeffrey W. Leon, Rochester, both of NY (US)

(73) Assignee: Kodak Polychrome Graphics LLC, Norwalk, CT (US)

( * ) Notice: Subject to any disclaimer, the term of this patent is extended or adjusted under 35 U.S.C. 154(b) by 0 days.

(21) Appl. No.: 09/293,389

(22) Filed: Apr. 16, 1999

(51) Int. Cl.[7] ..... G03C 1/76

(52) U.S. Cl. ..... 430/270.1; 430/281.1; 430/303

(58) Field of Search ..... 430/270.1, 302, 430/303, 281.1, 286.1

(56) References Cited

U.S. PATENT DOCUMENTS

| | | | | |
|---|---|---|---|---|
| 3,964,389 A | | 6/1976 | Peterson | 101/467 |
| 4,034,183 A | | 7/1977 | Uhlig | 219/122 |
| 4,081,572 A | | 3/1978 | Pacansky | 427/53 |
| 4,405,705 A | | 9/1983 | Etoh et al. | 430/270 |
| 4,548,893 A | | 10/1985 | Lee et al. | 430/296 |
| 4,634,659 A | | 1/1987 | Esumi et al. | 430/302 |
| 4,693,958 A | | 9/1987 | Schwartz et al. | 430/302 |
| 4,869,995 A | | 9/1989 | Shirai et al. | 430/270 |
| 4,940,749 A | | 7/1990 | Mori et al. | 524/547 |
| 4,994,520 A | | 2/1991 | Mori et al. | 524/547 |
| 5,460,918 A | | 10/1995 | Ali et al. | 430/200 |
| 5,512,418 A | | 4/1996 | Ma | 430/271.1 |
| 5,569,573 A | | 10/1996 | Takahashi et al. | 430/138 |
| 5,691,103 A | * | 11/1997 | Takeyama et al. | 430/200 |
| 5,925,484 A | * | 7/1999 | Shima et al. | 430/7 |
| 5,952,429 A | * | 9/1999 | Ikeda et al. | 525/326.1 |
| 5,985,514 A | * | 11/1999 | Zheng et al. | 430/270.1 |

FOREIGN PATENT DOCUMENTS

| | | | |
|---|---|---|---|
| EP | 0 341 825 B1 | 11/1989 | G03G/13/28 |
| EP | 0 652 483 A1 | 5/1995 | G03F/7/004 |
| EP | 0 773 478 A1 | 5/1997 | G03F/7/004 |
| JP | 197671 | 7/2000 | |
| WO | 92/09934 | 11/1990 | G03F/7/039 |

OTHER PUBLICATIONS

Rosen, Stephen L. Fundamental Principles of Polymeric materials. New York: John Wiley & Sons, Inc., 1993.*

Encyclopedia of Polymer Science and Technology; Plastics, Resins, Rubbers, Fibers. vol. 1, A to Amino Acids. United States: John Wiley & Sons, Inc., 1964.*

* cited by examiner

*Primary Examiner*—Janet Baxter
*Assistant Examiner*—Barbara Gilmore
(74) *Attorney, Agent, or Firm*—Baker Botts L.L.P.

(57) ABSTRACT

An imaging member, such as a negative-working printing plate or on-press cylinder, can be prepared with a hydrophilic imaging layer comprised of a heat-sensitive hydrophilic polymer having ionic moieties and a polymer grafted carbon as a photothermal conversion material. The heat-sensitive polymer and polymer grafted carbon can be formulated in water or water-miscible solvents without agglomeration. In the imaging member, the polymer reacts to provide increased hydrophobicity in areas exposed to energy that provides or generates heat. For example, heat can be supplied by laser irradiation in the IR region of the electromagnetic spectrum. The heat-sensitive polymer is considered "switchable" in response to heat, and provides a lithographic image without wet processing.

29 Claims, No Drawings

PROCESSLESS DIRECT WRITE IMAGING MEMBER CONTAINING POLYMER GRAFTED CARBON AND METHODS OF IMAGING AND PRINTING

FIELD OF THE INVENTION

This invention relates in general to thermal imaging compositions, and to lithographic imaging members (and particularly to lithographic printing plates) prepared therefrom. The invention also relates to a method of imaging such imaging members, and to a method of printing using them.

BACKGROUND OF THE INVENTION

The art of lithographic printing is based upon the immiscibility of oil and water, wherein an oily material or ink is preferentially retained by an imaged area and the water or fountain solution is preferentially retained by the non-imaged areas. When a suitably prepared surface is moistened with water and ink is then applied, the background or non-imaged areas retain the water and repel the ink while the imaged areas accept the ink and repel the water. The ink is then transferred to the surface of a suitable substrate, such as cloth, paper or metal, thereby reproducing the image.

Very common lithographic printing plates include a metal or polymer support having thereon an imaging layer sensitive to visible or UV light. Both positive- and negative-working printing plates can be prepared in this fashion. Upon exposure, and perhaps post-exposure heating, either imaged or non-imaged areas are removed using wet processing chemistries.

Thermally sensitive printing plates are becoming more common. Examples of such plates are described in U.S. Pat. No. 5,372,915 (Haley et al). They include an imaging layer comprising a mixture of dissolvable polymers and an infrared radiation absorbing compound. While these plates can be imaged using lasers and digital information, they require wet processing using alkaline developer solutions.

It has been recognized that a lithographic printing plate could be created by ablating an IR absorbing layer. For example, Canadian 1,050,805 (Eames) discloses a dry planographic printing plate comprising an ink receptive substrate, an overlying silicone rubber layer, and an interposed layer comprised of laser energy absorbing particles (such as carbon particles) in a self-oxidizing binder (such as nitrocellulose). Such plates were exposed to focused near IR radiation with a $Nd^{++}$ YAG laser. The absorbing layer converted the infrared energy to heat thus partially loosening, vaporizing or ablating the absorber layer and the overlying silicone rubber. Similar plates are described in *Research Disclosure* 19201, 1980 as having vacuum-evaporated metal layers to absorb laser radiation in order to facilitate the removal of a silicone rubber overcoated layer. These plates were developed by wetting with hexane and rubbing. Other publications describing ablatable printing plates include U.S. Pat. No. 5,385,092 (Lewis et al), U.S. Pat. No. 5,339,737 (Lewis et al), U.S. Pat. No. 5,353,705 (Lewis et al), U.S. Pat. No. Reissue 35,512 (Nowak et al), and U.S. Pat. No. 5,378,580 (Leenders).

While the noted printing plates used for digital, processless printing have a number of advantages over the more conventional photosensitive printing plates, there are a number of disadvantages with their use. The process of ablation creates debris and vaporized materials that must be collected. The laser power required for ablation can be considerably high, and the components of such printing plates may be expensive, difficult to coat, or unacceptable for resulting printing quality. Such plates generally require at least two coated layers on a support.

Thermally switchable polymers have been described for use as imaging materials in printing plates. By "switchable" is meant that the polymer is rendered from hydrophobic to relatively more hydrophilic or, conversely from hydrophilic to relatively more hydrophobic, upon exposure to heat. U.S. Pat. No. 4,034,183 (Uhlig) describes the use of high powered lasers to convert hydrophilic surface layers to hydrophobic surfaces. A similar process is described for converting polyamic acids into polyimides in U.S. Pat. No. 4,081,572 (Pacansky). The use of high-powered lasers is undesirable in the industry because of their high electrical power requirements and because of their need for cooling and frequent maintenance.

U.S. Pat. No. 4,634,659 (Esumi et al) describes imagewise irradiating hydrophobic polymer coatings to render exposed regions more hydrophilic in nature. While this concept was one of the early applications of converting surface characteristics in printing plates, it has the disadvantages of requiring long UV light exposure times (up to 60 minutes), and the plate's use is in a positive-working mode only.

U.S. Pat. No. 4,405,705 (Etoh et al) and U.S. Pat. No. 4,548,893 (Lee et al) describe amine-containing polymers for photosensitive materials used in non-thermal processes. Thermal processes using polyamic acids and vinyl polymers with pendant quaternary ammonium groups are described in U.S. Pat. No. 4,693,958 (Schwartz et al). U.S. Pat. No. 5,512,418 (Ma) describes the use of polymers having cationic quaternary ammonium groups that are heat-sensitive. However, the materials described in this art require wet processing after imaging.

WO 92/09934 (Vogel et al) describes photosensitive compositions containing a photoacid generator and a polymer with acid labile tetrahydropyranyl or activated ester groups. However, imaging of these compositions converts the imaged areas from hydrophobic to hydrophilic in nature.

In addition, EP-A 0 652 483 (Ellis et al) describes lithographic printing plates imageable using IR lasers, and which do not require wet processing. These plates comprise an imaging layer that becomes more hydrophilic upon imagewise exposure to heat. This coating contains a polymer having pendant groups (such as t-alkyl carboxylates) that are capable of reacting under heat or acid to form more polar, hydrophilic groups. Imaging such compositions converts the imaged areas from hydrophobic to relatively more hydrophilic in nature, and thus requires imaging the background of the plate, which is generally a larger area. This can be a problem when imaging to the edge of the printing plate is desired.

Copending and commonly assigned U.S. Ser. No. 09/162,905, filed on Sep. 29, 1998 by Leon, Underwood and Fleming, U.S. Ser. No. 09/163,020 filed on Sep. 29, 1998 by Leon, Underwood, Fleming and DeBoer, and U.S. Ser. No. 09/156,833 filed on Sep. 18, 1998 are directed to processless direct write printing plates that include an imaging layer containing heat sensitive polymers. The polymer coatings are sensitized to infrared radiation by the incorporation of an infrared absorbing material such as an organic dye or a fine dispersion of carbon black. Upon exposure to a high intensity infrared laser, light absorbed by the organic dye or carbon black is converted to heat, thereby promoting a physical change in the polymer (usually a change in hydrophilicity or hydrophobicity). The resulting printing plates can be used on conventional printing presses to provide, for example, negative images. Such printing plates have utility in the evolving "computer-to-plate" printing market.

Some of the heat-sensitive polymers described in the copending applications, particularly the polymers containing organoonium or other charged groups, have a tendency to undergo physical interactions or chemical reactions with the organic dye or carbon black, thus compromising the effectiveness of both polymers and heat-absorbing materials. In particular, while carbon black is an infrared radiation absorbing material of preference because of its low cost and absorption of light throughout the infrared region of the electromagnetic spectrum, its use also creates problems. For example, it cannot be readily dispersed out of water or the alcoholic solvents of choice. Special carbon black products that are designed to be water-dispersible (that is, have special surface functionalities), however, often agglomerate in the presence of polymers (including organoonium polymers) containing ionic groups due to chemical interactions.

Thus, the graphic arts industry is seeking an alternative means for providing a processless, direct-write lithographic imaging members that can be imaged without ablation, or the other problems noted above in relation to known processless direct write printing plates. It would also be desirable to have heat-sensitive imaging members that include components that are highly effective to convert light exposure into heat and that can be coated out of water or other environmentally suitable solvents without agglomeration.

SUMMARY OF THE INVENTION

The problems noted above are overcome with a composition useful for thermal imaging comprising:

a) a hydrophilic heat-sensitive ionomer, b) polymer grafted carbon, and c) water or a water-miscible organic solvent.

This invention also provides an imaging member comprising a support and having disposed thereon a hydrophilic heat-sensitive layer that is prepared from the composition described above.

Still further, this invention includes a method of imaging comprising the steps of:

A) providing the imaging member described above, and

B) imagewise exposing the imaging member to provide exposed and unexposed areas in the imaging layer of the imaging member, whereby the exposed areas are rendered more hydrophobic than the unexposed areas by heat provided by the imagewise exposure.

Still again, a method of printing comprises the steps of carrying out steps A and B noted above, and additionally:

C) contacting the imaging member with a fountain solution and a lithographic printing ink, and imagewise transferring that printing ink from the imaging member to a receiving material.

As used herein, the term "ionomer" refers to a charged polymer having at least 20 mol % of the recurring units negatively or positively charged. These ionomers are generally referred to as "charged polymers" in the following disclosure.

The imaging members of this invention have a number of advantages, and avoid the problems of previous printing plates. Specifically, the problems and concerns associated with ablation imaging (that is, imagewise removal of a surface layer) are avoided because the hydrophilicity of the imaging layer is changed imagewise by "switching" (preferably, irreversibly) exposed areas of its printing surface to be less hydrophilic (that is, become more hydrophobic when heated). Thus, the imaging layer stays intact during and after imaging (that is, no ablation is required). These advantages are achieved by using a hydrophilic heat-sensitive polymer having recurring ionic groups within the polymer backbone or chemically attached thereto. Such polymers and groups are described in more detail below. The polymers used in the imaging layer are readily prepared using procedures described herein, and the imaging members of this invention are simple to make and use without the need for post-imaging wet processing. The resulting printing members formed from the imaging members of this invention are generally negative-working. In some cases, the polymers are crosslinked upon exposure and provide increased durability to the imaging members. In other and preferred cases, the polymers are crosslinked upon application to a support and curing.

Positively charged polymers, such as organoonium polymers that are preferred in the practice of this invention are typically coated out of water and methanol, solvents that readily dissolve these water-soluble polymeric salts. Carbon black does not readily disperse in such solvents and in order to achieve aqueous dispersions, special concentrated carbon black products are required (for example, materials sold by Cabot Laboratories under the trade name CAB-O-JET).

We have found, however, that charged polymers, such as organoonium salt polymers and such ionic functionalized carbon particles are not compatible with one another. The present invention solves this problem with the use of polymer grafted carbons as the infrared absorbing material instead of conventional dispersed carbon particles. These materials are also known in the art as carbon black-grafted polymers. We have found that they are readily dispersed in water or water-miscible solvents such as alcohols, and that they do not agglomerate in the presence of charged polymers. The compositions of this invention can then be readily applied to suitable metal or polymer supports, and the resulting imaging members function as improved thermal processless printing plates.

Polymer grafted carbon also provides an advantage of sensitization in that it provides greater wavelength independence. That is, it provides for light absorption throughout the infrared region of the electromagnetic spectrum, and specifically over the wavelength range at which commercial thermal platesetters operate.

DETAILED DESCRIPTION OF THE INVENTION

The imaging members of this invention comprise a support and one or more layers thereon that include a dried heat-sensitive composition. The support can be any self-supporting material including polymeric films, glass, ceramics, cellulosic materials (including papers), metals or stiff papers, or a lamination of any of these materials. The thickness of the support can be varied. In most applications, the thickness should be sufficient to sustain the wear from printing and thin enough to wrap around a printing form. A preferred embodiment uses a polyester support prepared from, for example, polyethylene terephthalate or polyethylene naphthalate, and having a thickness of from about 100 to about 310 $\mu$m. Another preferred embodiment uses aluminum sheets having a thickness of from about 100 to about 600 $\mu$m. The support should resist dimensional change under conditions of use.

The support may also be a cylindrical support that includes printing cylinders on press as well as printing sleeves that are fitted over printing cylinders. The use of such supports to provide cylindrical imaging members is described in U.S. Pat. No. 5,713,287 (Gelbart). The heat-sensitive polymer composition can be coated or sprayed directly onto the cylindrical surface that is an integral part of the printing press.

The support may be coated with one or more "subbing" layers to improve adhesion of the final assemblage. Examples of subbing layer materials include, but are not limited to, gelatin and other naturally occurring and synthetic hydrophilic colloids and vinyl polymers (such as vinylidene chloride copolymers) that are known for such purposes in the photographic industry, vinylphosphonic acid polymers, sol gel materials such as those prepared from alkoxysilanes (including glycidoxypropyltriethoxysilane and aminopropyltriethoxysilane), epoxy functional polymers, and various ceramics.

The backside of the support may be coated with antistatic agents and/or slipping layers or matte layers to improve handling and "feel" of the imaging member.

The imaging members, however, preferably have only one layer on the support, that is a heat-sensitive surface layer that is required for imaging. This hydrophilic layer is prepared from a composition of this invention, and dried to include one or more heat-sensitive charged polymers and a polymer grafted carbon as a photothermal conversion material (described below). Because of the particular polymer(s) used in the imaging layer, the exposed (imaged) areas of the layer are rendered more hydrophobic in nature. The unexposed areas remain hydrophilic in nature.

In the heat-sensitive imaging layer of the imaging member, only the one or more charged polymers and polymer grafted carbon are essential for imaging. The charged polymers generally are comprised of recurring units, of which at least 20 mol % include ionic groups. Preferably, at least 30 mol % of the recurring groups include ionic groups. Thus each of these polymers has a net charge provided by these ionic groups. Preferably, the ionic groups are cationic groups.

The charged polymers (ionomers) useful in the practice of this invention can be of three broad classes of materials:

I) crosslinked or uncrosslinked vinyl polymers comprising recurring units comprising positively-charged, pendant N-alkylated aromatic heterocyclic groups, II) crosslinked or uncrosslinked polymers comprising recurring organoonium groups, and III) polymers comprising a pendant thiosulfate (Bunte salt) group.

Each class of polymer is described in turn. The imaging layer can include mixtures of polymers from each class, or a mixture of one or more polymers of two or more classes. The Class II polymers are preferred.

Class I Polymers

The Class I polymers generally have a molecular weight of at least 1000 and can be any of a wide variety of hydrophilic vinyl homopolymers and copolymers having the requisite positively-charged groups. They are prepared from ethylenically unsaturated polymerizable monomers using any conventional polymerization technique. Preferably, the polymers are copolymers prepared from two or more ethylenically unsaturated polymerizable monomers, at least one of which contains the desired pendant positively-charged group, and another monomer that is capable of providing other properties, such as crosslinking sites and possibly adhesion to the support. Procedures and reactants needed to prepare these polymers are well known. With the additional teaching provided herein, the known polymer reactants and conditions can be modified by a skilled artisan to attach a suitable cationic group.

The presence of a cationic group apparently provides or facilitates the "switching" of the imaging layer from hydrophilic to hydrophobic in the areas that have been exposed to heat in some manner, when the cationic group reacts with its counterion. The net result is the loss of charge. Such reactions are more easily accomplished when the anion is more nucleophilic and/or more basic. For example, an acetate anion is typically more reactive than a chloride anion. By varying the chemical nature of the anion, the reactivity of the heat-sensitive polymer can be modified to provide optimal image resolution for a given set of conditions (for example, laser hardware and power, and printing press needs) balanced with sufficient ambient shelf life. Useful anions include the halides, carboxylates, sulfates, borates and sulfonates. Representative anions include, but are not limited to, chloride, bromide, fluoride, acetate, tetrafluoroborate, formate, sulfate, p-toluenesulfonate and others readily apparent to one skilled in the art. The halides and carboxylates are preferred.

The aromatic cationic group is present in sufficient recurring units of the polymer so that the heat-activated reaction described above can provide desired hydrophobicity of the imaged printing layer. The groups can be attached along a principal backbone of the polymer, or to one or more branches of a polymeric network, or both. The aromatic groups generally comprise 5 to 10 carbon, nitrogen, sulfur or oxygen atoms in the ring (at least one being a positively-charged nitrogen atom), to which is attached a branched or unbranched, substituted or unsubstituted alkyl group. Thus, the recurring units containing the aromatic heterocyclic group can be represented by the Structure I:

I

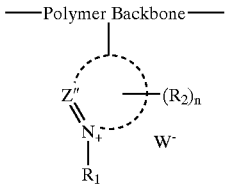

In this structure, $R_1$ is a branched or unbranched, substituted or unsubstituted alkyl group having from 1 to 12 carbon atoms (such as methyl, ethyl, n-propyl, isopropyl, t-butyl, hexyl, methoxymethyl, benzyl, neopentyl and dodecyl). Preferably, $R_1$ is a substituted or unsubstituted, branched or unbranched alkyl group having from 1 to 6 carbon atoms, and most preferably, it is substituted or unsubstituted methyl group.

$R_2$ can be a substituted or unsubstituted alkyl group (as defined above, and additionally a cyanoalkyl group, a hydroxyalkyl group or alkoxyalkyl group), substituted or unsubstituted alkoxy having 1 to 6 carbon atoms (such as methoxy, ethoxy, isopropoxy, oxymethylmethoxy, n-propoxy and butoxy), a substituted or unsubstituted aryl group having 6 to 14 carbon atoms in the ring (such as phenyl, naphthyl, anthryl, p-methoxyphenyl, xylyl, and alkoxycarbonylphenyl), halo (such as chloro and bromo), a substituted or unsubstituted cycloalkyl group having 5 to 8 carbon atoms in the ring (such as cyclopentyl, cyclohexyl and 4-methylcyclohexyl), or a substituted or unsubstituted heterocyclic group having 5 to 8 atoms in the ring including at least one nitrogen, sulfur or oxygen atom in the ring (such as pyridyl, pyridinyl, tetrahydrofuranyl and tetrahydropyranyl). Preferably, $R_2$ is substituted or unsubstituted methyl or ethyl group.

Z" represents the carbon and any additional nitrogen, oxygen, or sulfur atoms necessary to complete the 5- to 10-membered aromatic N-heterocyclic ring that is attached to the polymeric backbone. Thus, the ring can include two or more nitrogen atoms in the ring (for example, N-alkylated diazinium or imidazolium groups), or N-alkylated nitrogen-containing fused ring systems including, but not limited to, pyridinium, quinolinium, isoquinolinium acridinium, phenanthradinium and others readily apparent to one skilled in the art.

$W^-$ is a suitable anion as described above. Most preferably it is acetate or chloride.

Also in Structure I, n is 0 to 6, and is preferably 0 or 1. Most preferably, n is 0.

The aromatic heterocyclic ring can be attached to the polymeric backbone at any position on the ring. Preferably, there are 5 or 6 atoms in the ring, one or two of which are nitrogen. Thus, the N-alkylated nitrogen containing aromatic group is preferably imidazolium or pyridinium and most preferably it is imidazolium.

The recurring units containing the cationic aromatic heterocycle can be provided by reacting a precursor polymer containing unalkylated nitrogen containing heterocyclic units with an appropriate alkylating agent (such as alkyl sulfonate esters, alkyl halides and other materials readily apparent to one skilled in the art) using known procedures and conditions.

Preferred Class I polymers can be represented by the following Structure II:

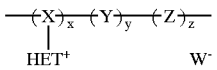

II wherein X represents recurring units to which the N-alkylated nitrogen containing aromatic heterocyclic groups (represented by $HET^-$) are attached, Y represents recurring units derived from ethylenically unsaturated polymerizable monomers that may provide active sites for crosslinking using any of various crosslinking mechanisms (described below), and Z represents recurring units derived from any additional ethylenically unsaturated polymerizable monomers. The various repeating units are present in suitable amounts, as represented by x being from about 20 to 100 mol %, y being from about 0 to about 20 mol %, and z being from 0 to 80 mol %. Preferably, x is from about 30 to about 98 mol %, y is from about 2 to about 10 mol % and z is from 0 to about 68 mol %.

Crosslinking of the polymers can be provided in a number of ways. There are numerous monomers and methods for crosslinking that are familiar to one skilled in the art. Some representative crosslinking strategies include, but are not necessarily limited to:

a) reacting an amine or carboxylic acid or other Lewis basic units with diepoxide crosslinkers, b) reacting an epoxide units within the polymer with difunctional amines, carboxylic acids, or other difunctional Lewis basic unit, c) irradiative or radical-initiated crosslinking of double bond-containing units such as acrylates, methacrylates, cinnamates, or vinyl groups, d) reacting a multivalent metal salts with ligating groups within the polymer (the reaction of zinc salts with carboxylic acid-containing polymers is an example), e) using crosslinkable monomers that react via the Knoevenagel condensation reaction, such as (2-acetoacetoxy)ethyl acrylate and methacrylate, f) reacting an amine, thiol, or carboxylic acid groups with a divinyl compound (such as bis (vinylsulfonyl) methane) via a Michael addition reaction, g) reacting a carboxylic acid units with crosslinkers having multiple aziridine units, h) reacting a crosslinkers having multiple isocyanate units with amines, thiols, or alcohols within the polymer, i) mechanisms involving the formation of interchain sol-gel linkages [such as the use of the 3-(trimethoxysilyl) propylmethacrylate monomer], j) oxidative crosslinking using an added radical initiator (such as a peroxide or hydroperoxide), k) autooxidative crosslinking, such as employed by alkyd resins, l) sulfur vulcanization, and m) processes involving ionizing radiation.

Monomers having crosslinkable groups or active crosslinkable sites (or groups that can serve as attachment points for crosslinking additives, such as epoxides) can be copolymerized with the other monomers noted above. Such monomers include, but are not limited to, 3-(trimethoxysilyl)propyl acrylate or methacrylate, cinnamoyl acrylate or methacrylate, N-methoxymethyl methacrylamide, N-aminopropylacrylamide hydrochloride, acrylic or methacrylic acid and hydroxyethyl methacrylate.

Additional monomers that provide the repeating units represented by "Z" in the Structure II above include any useful hydrophilic or oleophilic ethylenically unsaturated polymerizable monomer that may provide desired physical or printing properties to the hydrophilic imaging layer. Such monomers include, but are not limited to, acrylates, methacrylates, isoprene, acrylonitrile, styrene and styrene derivatives, acrylamides, methacrylamides, acrylic or methacrylic acid and vinyl halides.

Representative Class I polymers are identified hereinbelow as Polymers 1 and 3–6. Mixtures of these polymers can also be used. Polymer 2 below is a precursor to a useful Class I polymer.

Class II Polymers

The Class II polymers also generally have a molecular weight of at least 1000. They can be any of a wide variety of vinyl or non-vinyl homopolymers and copolymers.

Non-vinyl polymers of Class II include, but are not limited to, polyesters, polyamides, polyamide-esters, polyarylene oxides and derivatives thereof, polyurethanes, polyxylylenes and derivatives thereof, silicon-based sol gels (solsesquioxanes), polyamidoamines, polyimides, polysulfones, polysiloxanes, polyethers, poly(ether ketones), poly(phenylene sulfide) ionomers, polysulfides and polybenzimidazoles. Preferably, such non-vinyl polymers are silicon based sol gels, polyarylene oxides, poly (phenylene sulfide) ionomers or polyxylylenes, and most preferably, they are poly(phenylene sulfide) ionomers. Procedures and reactants needed to prepare all of these types of polymers are well known. With the additional teaching provided herein, the known polymer reactants and conditions can be modified by a skilled artisan to incorporate or attach a suitable cationic organoonium moiety.

Silicon-based sol gels useful in this invention can be prepared as a crosslinked polymeric matrix containing a silicon colloid derived from di-, tri- or tetraalkoxy silanes. These colloids are formed by methods described in U.S. Pat. No. 2,244,325, U.S. Pat. No. 2,574,902 and U.S. Pat. No. 2,597,872. Stable dispersions of such colloids can be conveniently purchased from companies such as the DuPont Company. A preferred sol-gel uses N-trimethoxysilylpropyl- N, N,N-trimethylammonium acetate both as the crosslinking agent and as the polymer layer forming material.

The presence of an organoonium moiety that is chemically incorporated into the polymer in some fashion apparently provides or facilitates the "switching" of the imaging layer from hydrophilic to oleophilic in the exposed areas upon exposure to energy that provides or generates heat, when the cationic moiety reacts with its counterion. The net result is the loss of charge. Such reactions are more easily accomplished when the anion of the organoonium moiety is more nucleophilic and/or more basic, as described above for the Class I polymers.

The organoonium moiety within the polymer can be chosen from a trisubstituted sulfur moiety (organosulfonium), a tetrasubstituted nitrogen moiety (organoammonium), or a tetrasubstituted phosphorous moiety (organophosphonium). The tetrasubstituted nitrogen (organoammonium) moieties are preferred. This moiety can be chemically attached to (that is, pendant) the polymer backbone, or incorporated within the backbone in some fashion, along with the suitable counterion. In either embodiment, the organoonium moiety is present in sufficient repeating units of the polymer (at least 20 mol %) so that the heat-activated reaction described above can occur to provide desired hydrophobicity of the imaging layer. When chemically attached as a pendant group, the organoonium moiety can be attached along a principal backbone of the polymer, or to one or more branches of a polymeric network, or both. When chemically incorporated within the polymer backbone, the moiety can be present in either cyclic or acyclic form, and can also form a branching point in a polymer network. Preferably, the organoonium moiety is provided as a pendant group along the polymeric backbone. Pendant organoonium moieties can be chemically attached to the polymer backbone after polymer formation, or functional groups on the polymer can be converted to organoonium moieties using known chemistry. For example, pendant quaternary ammonium groups can be provided on a polymeric backbone by the displacement of a "leaving group" functionality (such as a halogen) by a tertiary amine nucleophile. Alternatively, the organoonium group can be present on a monomer that is then polymerized or derived by the alkylation of a neutral heteroatom unit (trivalent nitrogen or phosphorous group or divalent sulfur group) already incorporated within the polymer.

The organoonium moiety is substituted to provide a positive charge. Each substituent must have at least one carbon atom that is directly attached to the sulfur, nitrogen or phosphorus atom of the organoonium moiety. Useful substituents include, but are not limited to, substituted or unsubstituted alkyl groups having 1 to 12 carbon atoms and preferably from 1 to 7 carbon atoms (such as methyl, ethyl, n-propyl, isopropyl, t-butyl, hexyl, methoxyethyl, isopropoxymethyl, substituted or unsubstituted aryl groups (phenyl, naphthyl, p-methylphenyl, m-methoxyphenyl, p-chlorophenyl, p-methylthiophenyl, p-N, N-dimethylaminophenyl, xylyl, methoxycarbonylphenyl and cyanophenyl), and substituted or unsubstituted cycloalkyl groups having 5 to 8 carbon atoms in the carbocyclic ring (such as cyclopentyl, cyclohexyl, 4-methylcyclohexyl and 3-methylcyclohexyl). Other useful substituents would be readily apparent to one skilled in the art, and any combination of the expressly described substituents is also contemplated.

The organoonium moieties include any suitable anion as described above for the Class I polymers. The halides and carboxylates are preferred.

Representative Class II non-vinyl polymers are identified herein below as Polymers 7–8 and 10. Mixtures of these polymers can also be used. Polymer 9 is a precursor to Polymer 10.

In addition, vinyl Class II polymers can be used in the practice of this invention. Like the non-vinyl polymers, such heat-sensitive polymers are composed of recurring units having one or more types of organoonium group. For example, such a polymer can have recurring units with both organoammonium groups and organosulfonium groups. It is also not necessary that all of the organoonium groups have the same alkyl substituents. For example, a polymer can have recurring units having more than one type of organoammonium group. Useful anions in these polymers are the same as those described above for the non-vinyl polymers. In addition, the halides and carboxylates are preferred.

The organoonium group is present in sufficient recurring units of the polymer so that the heat-activated reaction described above can occur to provide desired hydrophobicity of the imaged printing layer. The group can be attached along a principal backbone of the polymer, or to one or more branches of a polymeric network, or both. Pendant groups can be chemically attached to the polymer backbone after polymer formation using known chemistry. For example, pendant organoammonium, organophosphonium or organosulfonium groups can be provided on a polymeric backbone by the nucleophilic displacement of a pendant leaving group (such as a halide or sulfonate ester) on the polymeric chain by a trivalent amine, divalent sulfur or trivalent phosphorous nucleophile. Pendant onium groups can also be provided by alkylation of corresponding pendant neutral heteroatom groups (nitrogen, sulfur or phosphorous) using any commonly used alkylating agent such as alkyl sulfonate esters or alkyl halides. Alternatively a monomer precursor containing the desired organoammonium, organophosphonium or organosulfonium group may be polymerized to yield the desired polymer.

The organoammonium, organophosphonium or organosulfonium group in the vinyl polymer provides the desired positive charge. Generally, preferred pendant organoonium groups can be illustrated by the following Structures III, IV and V:

III

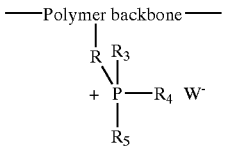

IV

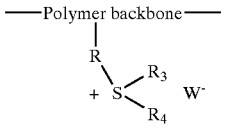

V

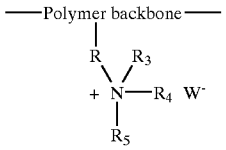

wherein R is a substituted or unsubstituted alkylene group having 1 to 12 carbon atoms that can also include one or more oxy, thio, carbonyl, amido or alkoxycarbonyl groups with the chain (such as methylene, ethylene, isopropylene, methylenephenylene, methyleneoxymethylene, n-butylene and hexylene), a substituted or unsubstituted arylene group having 6 to 10 carbon atoms in the ring (such as phenylene, naphthylene, xylylene and 3-methoxyphenylene), or a substituted or unsubstituted cycloalkylene group having 5 to 10 carbon atoms in the ring (such as 1,4-cyclohexylene, and 3-methyl-1,4-cyclohexylene). In addition, R can be a combination of two or more of the defined substituted or unsubstituted alkylene, arylene and cycloalkylene groups. Preferably, R is a substituted or unsubstituted ethyleneoxycarbonyl or phenylenemethylene group. Other useful substituents not listed herein could include combinations of any of those groups listed above as would be readily apparent to one skilled in the art.

$R_3$, $R_4$ and $R_5$ are independently substituted or unsubstituted alkyl group having 1 to 12 carbon atoms (such as methyl, ethyl, n-propyl, isopropyl, t-butyl, hexyl, hydroxymethyl, methoxymethyl, benzyl, methylenecarboalkoxy and a cyanoalkyl), a substituted or unsubstituted aryl group having 6 to 10 carbon atoms in the carbocyclic ring (such as phenyl, naphthyl, xylyl, p-methoxyphenyl, p-methylphenyl, m-methoxyphenyl, p-chlorophenyl, p-methylthiophenyl, p-N, N-dimethylaminophenyl, methoxycarbonylphenyl and cyanophenyl), or a substituted or unsubstituted cycloalkyl group having 5 to 10 carbon atoms in the carbocyclic ring (such as 1,3- or 1,4-cyclohexyl). Alternatively, any two of $R_3$, $R_4$ and $R_5$ can be combined to form a substituted or unsubstituted heterocyclic ring with the charged phosphorus, sulfur or nitrogen atom, the ring having 4 to 8 carbon, nitrogen, phosphorus, sulfur or oxygen atoms in the ring. Such heterocyclic rings include, but are not limited to, substituted or unsubstituted morpholinium, piperidinium and pyrrolidinium groups for Structure V. Other useful substituents for these various groups would be readily apparent to one skilled in the art, and any combinations of the expressly described substituents are also contemplated.

Preferably, $R_3$, $R_4$ and $R_5$ are independently substituted or unsubstituted methyl or ethyl groups.

$W^-$ is any suitable anion as described above for the Class I polymers. Acetate and chloride are preferred anions.

Polymers containing quaternary ammonium groups as described herein are most preferred vinyl Class II polymers.

In preferred embodiments, the vinyl Class II polymers useful in the practice of this invention can be represented by the following Structure VI:

VI

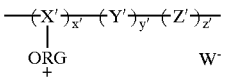

wherein X' represents recurring units to which the organoonium groups ("ORG") are attached, Y' represents recurring units derived from ethylenically unsaturated polymerizable monomers that may provide active sites for crosslinking using any of various crosslinking mechanisms (described below), and Z' represents recurring units derived from any additional ethylenically unsaturated polymerizable monomers. The various recurring units are present in suitable amounts, as represented by x' being from about 20 to about 99 mol %, y' being from about 1 to about 20 mol %, and z' being from 0 to about 79 mol %. Preferably, x' is from about 30 to about 98 mol %, y' is from about 2 to about 10 mol % and z' is from 0 to about 68 mol %.

Crosslinking of the vinyl polymer can be achieved in the same way as described above for the Class I polymers.

Additional monomers that provide the additional recurring units represented by Z' in Structure VI include any useful hydrophilic or oleophilic ethylenically unsaturated polymerizable monomer that may provide desired physical or printing properties to the imaging layer. Such monomers include, but are not limited to, acrylates, methacrylates, acrylonitrile, isoprene, styrene and styrene derivatives, acrylamides, methacrylamides, acrylic or methacrylic acid and vinyl halides.

Representative vinyl polymers of Class II include Polymers 11–18 as identified herein below, and Polymer 14 is most preferred. A mixture of any two or more of these polymers can also by used.

Class III Polymers

Each of the Class III polymers has a molecular weight of at least 1000, and preferably of at least 5000. For example, the polymers can be vinyl homopolymers or copolymers prepared from one or more ethylenically unsaturated polymerizable monomers that are reacted together using known polymerization techniques and reactants. Alternatively, they can be addition homopolymers or copolymers (such as polyethers) prepared from one or more heterocyclic monomers that are reacted together using known polymerization techniques and reactants. Additionally, they can be condensation type polymers (such as polyesters, polyimides, polyamides or polyurethanes) prepared using known polymerization techniques and reactants. Whatever the type of polymers, at least 20 mol % (preferably 30 mol %) of the total recurring units in the polymer comprise the necessary heat-activatable thiosulfate groups.

The Class III polymers useful in the practice of this invention can be represented by the Structure VII wherein the thiosulfate group (or Bunte salt) is a pendant group:

VII

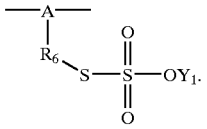

wherein A represents a polymeric backbone, $R_6$ is a divalent linking group, and $Y_1$ is hydrogen or a cation.

Useful polymeric backbones include, but are not limited to, vinyl polymers, polyethers, polyimides, polyamides, polyurethanes and polyesters. Preferably, the polymeric backbone is a vinyl polymer or polyether.

Useful $R_6$ linking groups include $—(COO)_n(Z_1)_m—$ wherein n is 0 or 1, m is 0 or 1, and $Z_1$ is a substituted or unsubstituted alkylene group having 1 to 6 carbon atoms (such as methylene, ethylene, n-propylene, isopropylene, butylenes, 2-hydroxypropylene and 2-hydroxy-4-azahexylene) that can have one or more oxygen, nitrogen or sulfur atoms in the chain, a substituted or unsubstituted arylene group having 6 to 14 carbon atoms in the aromatic ring (such as phenylene, naphthalene, anthracylene and xylylene), or a substituted or unsubstituted arylenealkylene (or alkylenearylene) group having 7 to 20 carbon atoms in the chain (such as p-methylenephenylene, phenylenemethylene-phenylene, biphenylene and phenyleneisopropylenephenylene). In addition, $R_6$ can be an alkylene group, an arylene group, in an arylenealkylene group as defined above for $Z_1$.

Preferably, $R_6$ is an alkylene group of 1 to 3 carbon atoms, an arylene group of 6 carbon atoms in the aromatic ring, an arylenealkylene group of 7 or 8 carbon atoms in the chain, or $—COO(Z_1)_m—$ wherein $Z_1$ is methylene, ethylene or phenylene. Most preferably, $R_6$ is phenylene, methylene or —COO—.

$Y_1$ is hydrogen, ammonium ion, or a metal ion (such as sodium, potassium, magnesium, calcium, cesium, barium, zinc or lithium ion). Preferably, $Y_1$ is hydrogen, sodium ion or potassium ion.

As the thiosulfate group is generally pendant to the backbone, preferably it is part of an ethylenically unsaturated polymerizable monomer that can be polymerized using conventional techniques to form vinyl homopolymers of the thiosulfate-containing recurring units, or vinyl copolymers when copolymerized with one or more additional ethylenically unsaturated polymerizable monomers. The thiosulfate-containing recurring units generally comprise at least 20 mol % of all recurring units in the polymer, preferably they comprise from about 30 to 100 mol % of all recurring units. A polymer can include more than one type of repeating unit containing a thiosulfate group as described herein.

Polymers having the above-described thiosulfate group are believed to crosslink and to switch from hydrophilic thiosulfate to hydrophobic disulfide (upon loss of sulfate) with heating.

Thiosulfate-containing molecules (or Bunte salts) can be prepared from the reaction between an alkyl halide and thiosulfate salt as taught by Bunte, *Chem. Ber.* 7, 646, 1884. Polymers containing thiosulfate groups can either be prepared from functional monomers or from preformed polymers. Polymers can also be prepared from preformed polymers in a similar manner as described in U.S. Pat. No. 3,706,706 (Vandenberg). Thiosulfate-containing molecules can also be prepared by reaction of an alkyl epoxide with a thiosulfate salt, or between an alkyl epoxide and a molecule containing a thiosulfate moiety (such as 2-aminoethanethiosulfuric acid), and the reaction can be performed either on a monomer or polymer as illustrated by Thames, *Surf. Coating*, 3 (Waterborne Coat.), Chapter 3, pp. 125–153, Wilson et al (Eds.).

Representative synthetic methods for making ethylenically unsaturated polymerizable monomers and Class III polymers (Polymers 19–28) are illustrated below. Vinyl polymers can be prepared by copolymerizing monomers containing the thiosulfate functional groups with one or more other ethylenically unsaturated polymerizable monomers to modify polymer chemical or functional properties, to optimize imaging member performance, or to introduce additional crosslinking capability.

Useful additional ethylenically unsaturated polymerizable monomers include, but are not limited to, acrylates (including methacrylates) such as ethyl acrylate, n-butyl acrylate, methyl methacrylate and t-butyl methacrylate, acrylamides (including methacrylamides), an acrylonitrile (including methacrylonitrile), vinyl ethers, styrenes, vinyl acetate, dienes (such as ethylene, propylene, 1,3-butadiene and isobutylene), vinyl pyridine and vinylpyrrolidone. Acrylamides, acrylates and styrenes are preferred.

The imaging layer of the imaging member can include one or more Class I, II or III polymers with or without minor amounts (less than 20 weight %, based on total dry weight of the layer) of additional binder or polymeric materials that will not adversely affect its imaging properties.

In the composition used to provide the heat-sensitive layer, the amount of charged polymer is generally present in an amount of at least 1% solids, and preferably at least 2% solids. A practical upper limit of the amount of charged polymer in the composition is about 10% solids.

The amount of charged polymer(s) used in the imaging layer is generally at least 0.1 $g/m^2$, and preferably from about 0.1 to about 10 $g/m^2$ (dry weight). This generally provides an average dry thickness of from about 0.1 to about 10 $\mu$m.

The imaging layer can also include one or more conventional surfactants for coatability or other properties, dyes or colorants to allow visualization of the written image, or any other addenda commonly used in the lithographic art, as long as the concentrations are low enough so they are inert with respect to imaging or printing properties.

It is essential that the heat-sensitive imaging layer includes one or more photothermal conversion materials to absorb appropriate radiation from an appropriate energy source (such as a laser), which radiation is converted into heat. Thus, such materials convert photons into heat phonons. Preferably, the radiation absorbed is in the infrared and near-infrared regions of the electromagnetic spectrum. The photothermal conversion materials useful in this invention are what are known in the art as polymer grafted carbon materials.

Thus, the term "polymer grafted carbon" denotes a chemically modified carbon black in which a synthetic polymer or copolymer is covalently bonded to the surface of the carbon particles. Such modified carbons materials typically have improved dispersibility in specific solvents due to the steric stabilization imparted by the polymer grafts. It is well known in the art that specific surface functionalities can be introduced onto the surface of carbonaceous materials through a wide variety of known methods including electrical discharge treatment (JP 6-025572), treatment with ultraviolet radiation (JP 5-339516), chemical oxidation (FR-A-911,059, CA-A-537,787, FR-A-1,195,792, GB-A-895, 990, U.S. Pat. No. 2,439,442 and U.S. Pat. No. 3,216,843), and through control of the pyrolytic conditions under which the carbon black is manufactured ["Carbon Black," Marcel-Dekker, New York, 15 (1976)].

Numerous techniques have been reported for using these induced surface functionalities as points of attachment for the grafting of synthetic polymers. One common strategy includes the reaction of a carbon black containing a reactive surface group with a polymer or copolymer containing specific chemical moieties known to react with such a group (JP 9-059331 and JP 8-337624). One such example is the modification of a carboxylic acid functionalized carbon with a polymer or copolymer containing aziridine, oxazoline, thioepoxide, N-hydroxyalkylamide, or epoxide moieties (U.S. Pat. No. 4,880,857). Alternatively, a polymerization reaction can be carried out in the presence of a carbon black that is surface functionalized with chemical groups capable of initiating or terminating the polymerization. In JP 6-263830, such a procedure is reported in which a peroxide-functionalized carbon black is used to initiate the polymerization of vinylic monomers. Other such preparations are reported in JP 3-174422 and JP 56-129210.

Ionizing radiation (JP 59-152917 and JP 55-147561) and electrical treatment (JP 57-005711) have also been used to graft polymers onto a carbon surface.

The types of polymers that have been grafted to carbon include vinylic/acrylic polymers, condensation polymers (such as polyesters and polyurethanes), silicones, poly (alkylene oxides) and block, graft, and random copolymers and hybrids thereof (U.S. Pat. No. 4,880,857 and U.S. Pat. No. 4,940,749).

The polymer grafted carbon is generally present in the heat-sensitive imaging layer in an amount sufficient to provide an optical transmission density of at least 0.1, and preferably at least 0.4, at the operating wavelength of the imaging laser (for example, 830 nm). The particular amount needed for this purpose would be readily apparent to one skilled in the art, depending upon the specific material used. For example, the net amount of carbon present in the compositions of this invention in an amount of at least 0.1 %, preferably at least 0.2% solids, and generally up to 1% solids.

The amount of polymer grafted to the carbon may vary in the weight ratio of from about 0.2:1 to about 4:1, and preferably from about 0.2:1 to about 1:1.

Carbon particle size can also vary. Preferred carbon particles are greater than 0.1 μm and less than 1 μm. Particularly preferred particles are less than 0.5 μm.

The heat-sensitive compositions and imaging layers can include additional photothermal conversion materials, although the presence of such materials is not preferred. Such optional materials can be dyes, pigments, evaporated pigments, semiconductor materials, alloys, metals, metal oxides, metal sulfides or combinations thereof, or a dichroic stack of materials that absorb radiation by virtue of their refractive index and thickness. Borides, carbides, nitrides, carbonitrides, bronze-structured oxides and oxides structurally related to the bronze family but lacking the $WO_{2.9}$ component, are also useful. Useful absorbing dyes for near infrared diode laser beams are described, for example, in U.S. Pat. No. 4,973,572 (DeBoer). Particular dyes of interest are "broad band" dyes, that is those that absorb over a wide band of the spectrum.

Alternatively, the same or different photothermal conversion material (including a polymer grafted carbon) can be included in a separate layer that is in thermal contact with the heat-sensitive imaging layer. Thus, during imaging, the action of the additional photothermal conversion material can be transferred to the heat-sensitive imaging layer.

The heat-sensitive composition of this invention can be applied to a support using any suitable equipment and procedure, such as spin coating, knife coating, gravure coating, dip coating or extrusion hopper coating. In addition, the composition can be sprayed onto a support, including a cylindrical support, using any suitable spraying means for example as described in U.S. Pat. No. 5,713,287 (noted above).

The heat-sensitive compositions of this invention are generally formulated in and coated from water or water-miscible solvents including, but not limited to, water-miscible alcohols (for example, methanol, ethanol, isopropanol, 1-methoxy-2-propanol and n-propanol), methyl ethyl ketone, tetrahydrofuran, acetonitrile and acetone. Water, methanol, ethanol and 1-methoxy-2-propanol are preferred. Mixtures (such as a mixture of water and methanol) of these solvents can also be used if desired.

The imaging members of this invention can be of any useful form including, but not limited to, printing plates, printing cylinders, printing sleeves and printing tapes (including flexible printing webs), all of any suitable size or dimensions. Preferably, the imaging members are printing plates or on-press cylinders.

During use, the imaging member of this invention is exposed to a suitable source of energy that generates or provides heat, such as a focused laser beam or a thermoresistive head, in the foreground areas where ink is desired in the printed image, typically from digital information supplied to the imaging device. A laser used to expose the imaging member of this invention is preferably a diode laser, because of the reliability and low maintenance of diode laser systems, but other lasers such as gas or solid state lasers may also be used. The combination of power, intensity and exposure time for laser imaging would be readily apparent to one skilled in the art. Specifications for lasers that emit in the near-IR region, and suitable imaging configurations and devices are described in U.S. Pat. No. 5,339,737 (Lewis et al), incorporated herein by reference. The imaging member is typically sensitized so as to maximize responsiveness at the emitting wavelength of the laser. For carbon black sensitization, the carbon particle size may be selected to maximize absorption.

The imaging apparatus can operate on its own, functioning solely as a platemaker, or it can be incorporated directly into a lithographic printing press. In the latter case, printing may commence immediately after imaging, thereby reducing press set-up time considerably. The imaging apparatus can be configured as a flatbed recorder or as a drum recorder, with the imaging member mounted to the interior or exterior cylindrical surface of the drum.

In the drum configuration, the requisite relative motion between an imaging device (such as laser beam) and the imaging member can be achieved by rotating the drum (and the imaging member mounted thereon) about its axis, and moving the imaging device parallel to the rotation axis, thereby scanning the imaging member circumferentially so the image "grows" in the axial direction. Alternatively, the beam can be moved parallel to the drum axis and, after each pass across the imaging member, increment angularly so that the image "grows" circumferentially. In both cases, after a complete scan by the laser beam, an image corresponding to the original document or picture can be applied to the surface of the imaging member.

In the flatbed configuration, a laser beam is drawn across either axis of the imaging member, and is indexed along the other axis after each pass. Obviously, the requisite relative motion can be produced by moving the imaging member rather than the laser beam.

While laser imaging is preferred in the practice of this invention, imaging can be provided by any other means that provides or generates thermal energy in an imagewise fashion. For example, imaging can be accomplished using a thermoresistive head (thermal printing head) in what is known as "thermal printing", described for example in U.S. Pat. No. 5,488,025 (Martin et al). Such thermal printing heads are commercially available (for example, as Fujisu Thermal Head FTP-040 MCS001 and TDK Thermal Head F415 HH7-1089).

Imaging of heat-sensitive compositions on printing press cylinders can be accomplished using any suitable means, for example, as taught in U.S. Pat. No. 5,713,287 (noted above), that is incorporated herein by reference.

After imaging, the imaging member can be used for printing without conventional wet processing. Applied ink can be imagewise transferred to a suitable receiving material (such as cloth, paper, metal, glass or plastic) to provide one or more desired impressions. If desired, an intermediate blanket roller can be used to transfer the ink from the imaging member to the receiving material. The imaging members can be cleaned between impressions, if desired, using conventional cleaning means.

The following examples illustrate the practice of the invention, and are not meant to limit it in any way. The synthetic methods are presented to show how some of the preferred heat-sensitive polymers can be prepared.

Polymers 1, 3–6 are illustrative of Class I polymers (Polymer 2 is a precursor to Polymer 3), Polymers 7–8 and 10 are illustrative of Class II non-vinyl polymers (Polymer 9 is a precursor to Polymer 10), Polymers 11–18 are illustrative of Class II vinyl polymers, and Polymers 19–28 are illustrative of Class III polymers.

Synthetic Methods

Preparation of Polymer 1: Poly(1-Vinyl-3-methylimidazolium Chloride-co-N-(3-aminopropyl) methacrylamide Hydrochloride)

A] Preparation of 1-Vinyl-3-methylimidazolium Methanesulfonate Monomer:

Freshly distilled 1-vinylimidazole (20.00 g, 0.21 mol) was combined with methyl methanesulfonate (18.9 ml, 0.22 mol)

and 3-t-butyl-4-hydroxy-5-methylphenyl sulfide (about 1 mg) in diethyl ether (100 ml) in a round bottomed flask equipped with a reflux condenser and a nitrogen inlet and stirred at room temperature for 48 hours. The resulting precipitate was filtered off, thoroughly washed with diethyl ether, and dried overnight under vacuum at room temperature to afford 37.2 g of product as a white, crystalline powder (86.7% yield).

B] Copolymerization/ion Exchange:

1-Vinyl-3-methylimidazolium methanesulfonate (5.00 g, $2.45\times10^{-2}$ mol), N-(3-aminopropyl) methacrylamide hydrochloride (0.23 g, $1.29\times10^{-3}$ mol) and 2,2'-azobisisobutyronitrile (AIBN) (0.052 g, $3.17\times10^{-4}$ mol) were dissolved in methanol (60 ml) in a 250 ml round bottomed flask equipped with a rubber septum. The solution was bubble degassed with nitrogen for ten minutes and heated at 60° C. in a water bath for 14 hours. The viscous solution was precipitated into 3.5 liters of tetrahydrofuran and dried under vacuum overnight at 50° C. to give 4.13 g of product (79.0 % yield). The polymer was then dissolved in 100 ml methanol and converted to the chloride by passage through a flash column containing 400 $cm^3$ DOWEX® 1×8–100 ion exchange resin.

Preparation of Polymer 2: Poly(methyl methacrylate-co-4-vinylpyridine)(9:1 Molar Ratio)

Methyl methacrylate (30 ml), 4-vinylpyridine (4 ml), AIBN (0.32 g, $1.95\times10^{-3}$ mol), and N,N-dimethylforamide (40 ml, DMF) were combined in a 250 ml round bottomed flask and fitted with a rubber septum. The solution was purged with nitrogen for 30 minutes and heated for 15 hours at 60° C. Methylene chloride and DMF (150 ml of each) were added to dissolve the viscous product and the product solution was precipitated twice into isopropyl ether. The precipitated polymer was filtered and dried overnight under vacuum at 60° C.

Preparation of Polymer 3: Poly(methyl Methacrylate-co-N-methyl-4-vinylpyridinium Formate) (9:1 Molar Ratio)

Polymer 2 (10 g) was dissolved in methylene chloride (50 ml) and reacted with methyl p-toluenesulfonate (1 ml) at reflux for 15 hours. NMR analysis of the reaction showed that only partial N-alkylation had occurred. The partially reacted product was precipitated into hexane, then dissolved in neat methyl methanesulfonate (25 ml) and heated at 70° C. for 20 hours. The product was precipitated once into diethyl ether and once into isopropyl ether from methanol and dried under vacuum overnight 60° C. A flash chromatography column was loaded with 300 $cm^3$ of DOWEX® 550 hydroxide ion exchange resin in water eluent. This resin was converted to the formate by running a liter of 10% formic acid through the column. The column and resin were thoroughly washed with methanol, and the product polymer (2.5 g) was dissolved in methanol and passed through the column. Complete conversion to the formate counterion was confirmed by ion chromatography.

Preparation of Polymer 4: Poly(methyl Methacrylate-co-N-butyl-4-vinylpyridinium Formate) (9:1 Molar Ratio)

Polymer 2 (5 g) was heated at 60° C. for 15 hours in 1-bromobutane (200 ml). The precipitate that formed was dissolved in methanol, precipitated into diethyl ether, and dried for 15 hours under vacuum at 60° C. The polymer was converted from the bromide to the formate using the method described in the preparation of Polymer 3.

Preparation of Polymer 5: Poly(methyl Methacrylate-co-2-vinylpyridine) (9:1 Molar Ratio)

Methyl methacrylate (18 ml), 2-vinylpyridine (2 ml), AIBN (0.16 g,), and DMF (30 ml) were combined in a 250 ml round bottomed flask and fitted with a rubber septum. The solution was purged with nitrogen for 30 minutes and heated for 15 hours at 60° C. Methylene chloride (50 ml) was added to dissolve the viscous product and the product solution was precipitated twice into isopropyl ether. The precipitated polymer was filtered and dried overnight under vacuum at 60° C.

Preparation of Polymer 6: Poly(methyl Methacrylate-co-N-methyl-2-vinylpyridinium Formate) (9:1 Molar Ratio)

Polymer 5 (10 g) was dissolved in 1,2-dichloroethane (100 ml) and reacted with methyl-p-toluenesulfonate (15 ml) at 70° C. for 15 hours. The product was precipitated twice into diethyl ether and dried under vacuum overnight at 60° C. A sample (2.5 g) of this polymer was converted from the p-toluenesulfonate to the formate using the procedure described above for Polymer 3.

Preparation of Polymer 7: Poly(p-xylidenetetrahydro-thiophenium Chloride)

Xylylene-bis-tetrahydrothiophenium chloride (5.42 g, 0.015 mol) was dissolved in 75 ml of deionized water and filtered through a fritted glass funnel to remove a small amount of insolubles. The solution was placed in a three-neck round-bottomed flask on an ice bath and was sparged with nitrogen for fifteen minutes. A solution of sodium hydroxide (0.68 g, 0.017 mol) was added dropwise over fifteen minutes via addition funnel. When about 95% of the hydroxide solution was added, the reaction solution became very viscous and the addition was stopped. The reaction was brought to pH 4 with 10% HCl and purified by dialysis for 48 hours.

Preparation of Polymer 8: Poly[phenylene Sulfide-co-methyl(4-thiophenyl)sulfonium Chloride]

Poly (phenylene sulfide) (15.0 g, 0.14 mol-repeating units), methanesulfonic acid (75 ml), and methyl triflate (50.0 g, 0.3 mol) were combined in a 500 ml round bottomed flask equipped with a heating mantle, reflux condenser, and nitrogen inlet. The reaction mixture was heated to 90° C. at which point a homogeneous, brown solution resulted, and was allowed to stir at room temperature overnight. The reaction mixture was poured into 500 $cm^3$ of ice and brought to neutrality with sodium bicarbonate. The resultant liquid/solid mixture was diluted to a final volume of 2 liters with water and dialyzed for 48 hours at which point most of the solids had dissolved. The remaining solids were removed by filtration and the remaining liquids were slowly concentrated to a final volume of 700 ml under a stream of nitrogen. The polymer was ion exchanged from the triflate to the chloride by passing it through a column of DOWEX® 1×8–100 resin. Analysis by $^1H$ NMR showed that methylation of about 45% of the sulfur groups had occurred.

Preparation of Polymer 9: Brominated Poly(2,6-dimethyl-1,4-phenylene Oxide)

Poly (2,6-dimethyl-1,4-phenylene oxide) (40 g, 0.33 mol repeating units) was placed dissolved in carbon tetrachloride (2400 ml) in a 5 liter round bottomed 3-neck flask with a reflux condenser and a mechanical stirrer. The solution was heated to reflux and a 150 Watt flood lamp was applied. N-bromosuccinimide (88.10 g, 0.50 g) was added portion-wise over 3.5 hours, and the reaction was allowed to stir at reflux for an additional hour. The reaction was cooled to room temperature to yield an orange solution over a brown solid. The liquid was decanted and the solids were stirred with 100 ml methylene chloride to leave a white powder (succinimide) behind. The liquid phases were combined, concentrated to 500 ml via rotary evaporation, and precipitated into methanol to yield a yellow powder. The crude product was precipitated twice more into methanol and dried overnight under vacuum at 60° C. Elemental and $^1$H NMR analyses showed a net 70% bromination of benzyl side chains.

Preparation of Polymer 10: Dimethyl Sulfonium Bromide Derivative of Poly(2,6-dimethyl-1,4-phenylene Oxide)

Brominated poly(2,6-dimethyl-1,4-phenylene oxide) described above (2.00 g, 0.012 mol benzyl bromide units) was dissolved in methylene chloride (20 ml) in a 3-neck round bottomed flask outfitted with a condenser, nitrogen inlet, and septum. Water (10 ml) was added along with dimethyl sulfide (injected via syringe) and the two-phase mixture was stirred at room temperature for one hour and then at reflux at which point the reaction turned into a thick dispersion. This was poured into 500 ml of tetrahydrofuran and agitated vigorously in a chemical blender. The product, which gelled after approximately an hour in the solid state, was recovered by filtration and quickly redissolved in 100 ml methanol and stored as a methanolic solution.

Preparation of Polymer 11: Poly[methyl Methacrylate-co-2-trimethylammoniumethyl Methacrylic Chloride-co-N-(3-aminopropyl) Methacrylamide Hydrochloride] (7:2:1 Molar Ratio)

Methyl methacrylate (24.6 ml, 0.23 mol), 2-trimethylammoniumethyl methacrylic chloride (17.0 g, 0.08 mol), n-(3-aminopropyl) methacrylamide hydrochloride (10.6 g, 0.56 mol), azobisisobutyronitrile (0.15 g, $9.10\times10^{-4}$ mol, AIBN), water (20 ml) and dimethylformamide (150 ml) were combined in a round bottom flask fitted with a rubber septum. The solution was bubble degassed with nitrogen for 15 minutes and placed in a heated water bath at 60° C. overnight. The viscous product solution was diluted with methanol (125 ml) and precipitated three times from methanol into isopropyl ether. The product was dried under vacuum at 60° C. for 24 hours and stored in a dessicator.

Preparation of Polymer 12: Poly[methyl Methacrylate-co-2-trimethylammoniumethyl Methacrylic Acetate-co-N-(3-aminopropyl) methacrylamide] (7:2:1 Molar Ratio)

Polymer 11 (3.0 g) was dissolved in 100 ml of methanol and neutralized by passing through a column containing 300 $cm^3$ of tertiary amine functionalized crosslinked polystyrene resin (Scientific Polymer Products #726, 300 $cm^2$) with methanol eluent. That polymer was then converted to the acetate using a column of 300 $cm^3$ DOWEX® 1×8–100 ion exchange resin (that is, converted from the chloride to the acetate by washing with 500 ml glacial acetic acid) and methanol eluent.

Preparation of Polymer 13: Poly[methyl Methacrylate-co-2-trimethylammoniumethyl Methacrylic Fluoride-co-N-(3-aminopropyl) Methacrylamide Hydrochloride] (7:2:1 Molar Ratio)

Polymer 11 (3.0 g) was dissolved in 100 ml of methanol and neutralized by passing through a column containing 300 $cm^3$ tertiary amine functionalized crosslinked polystyrene resin (Scientific Polymer Products #726, 300 $cm^2$) with methanol eluent. The polymer was then converted to the fluoride using a column of 300 $m^3$DOWEX® 1×8–100 ion exchange resin (that is, converted from the chloride to the fluoride by washing with 500 g of potassium fluoride) and methanol eluent.

Preparation of Polymer 14: Poly[vinylbenzyl Trimethylammonium Chloride-co-N-(3-aminopropyl) methacrylamide Hydrochloride] (19:1 Molar Ratio)

Vinylbenzyl trimethylammonium chloride (19 g, 0.0897 mol, 60:40 mixture of p,m isomers), N-(3-aminopropyl) methacrylamide hydrochloride (1 g, 0.00562 mol), 2,2'-azobis(2-methylpropionamidine) dihydrochloride (0.1g), and deionized water (80 ml) were combined in a round bottom flask fitted with a rubber septum. The reaction mixture was bubble degassed with nitrogen for 15 minutes and placed in a water bath at 60° C. for four hours. The resulting viscous product solution was precipitated into acetone, dried under vacuum at 60° C. for 24 hours, and stored in a dessicator.

Preparation of Polymer 15: Poly ([vinylbenzyltrimethyl-phosphonium Acetate-co-N-(3-aminopropyl) Methacrylamide Hydrochloride] (19:1 Molar Ratio)

A] Vinylbenzyl bromide (60:40 mixture of p,m isomers):

Vinylbenzyl chloride (50.60 g, 0.33 mol, 60:40 mixture of p,m isomers), sodium bromide (6.86 g, $6.67\times10^{-2}$ mol), N-methylpyrrolidone (300 ml, passed through a short column of basic alumina), ethyl bromide (260 g), and 3-t-butyl-4-hydroxy-5-methyl phenyl sulfide (1.00 g, $2.79\times10^{-3}$ mol) were combined in a 1 liter round bottomed flask fitted with a reflux condenser and a nitrogen inlet and the mixture was heated at reflux for 72 hours at which point the reaction was found to have proceeded to >95% conversion by gas chromatography. The reaction mixture was poured into 1 liter of water and extracted twice with 300 ml of diethyl ether. The combined ether layers were extracted twice with 1 liter of water, dried over $MgSO_4$, and the solvents were stripped by rotary evaporation to yield yellowish oil. The crude product was purified by vacuum distillation to afford 47.5 g of product (53.1% yield).

B] Vinylbenzyl trimethylphosphonium Bromide:

Trimethylphosphine (50.0 ml of a 1.0 molar solution in tetrahydrofuran, $5.00\times10^{-2}$ mol) was added via addition funnel over about 2 minutes into a thoroughly nitrogen degassed dispersion of vinylbenzyl bromide (9.85 g, $5.00\times10^{-2}$ mol) in diethyl ether (100 ml). A solid precipitate began to form almost immediately. The reaction was allowed to stir for 4 hours at room temperature, then was placed in a freezer overnight. The solid product was isolated by filtration, washed three times with 100 ml of diethyl ether, and dried under vacuum for 2 hours. Pure product (11.22 g) was recovered as a white powder (82.20% yield).

C] Poly[vinylbenzyltrimethylphosphonium Bromide-co-N-(3-aminopropyl)methacrylamide] (19:1 Molar Ratio):

Vinylbenzyltrimethylphosphonium bromide (5.00 g, $1.83\times10^{-2}$ mol), N-(3-aminopropyl) methacrylamide hydrochloride (0.17 g, $9.57\times10^{-4}$ mol), azobisisobutyronitrile (0.01 g, $6.09\times10^{-5}$ mol), water (5.0 ml), and dimethylformamide (25 ml) were combined in a 100 ml round bottomed flask sealed with a rubber septum, bubble degassed for 10 minutes with nitrogen, and placed in a warm water bath (55° C.) overnight. The viscous solution was precipitated into tetrahydrofuran and dried under vacuum overnight at 60° C. The liquids were filtered off, concentrated on a rotary evaporator to a volume of about 200 ml, precipitated again into tetrahydrofuran, and dried under vacuum overnight at 60° C. About 4.20 g was recovered. (81.9% yield).

D] Poly[vinylbenzyltrimethylphosphonium Acetate-co-N-(3-aminopropyl)methacrylamide Hydrochloride] (19:1 Molar Ratio):

DOWEX® 550 a hydroxide anion exchange resin (about 300 $cm^3$) was poured into a flash column with 3:1 methanol/water eluent. About 1 liter of glacial acetic acid was passed through the column to convert it to the acetate, followed by about 3 liters of 3:1 methanol/water. 3.0 g of the product from step C in 200 ml of 3:1 methanol/water was passed through the acetate resin column and the solvents were stripped on a rotary evaporator. The resulting viscous oil was thoroughly dried under vacuum to afford 2.02 g of a glassy, yellowish material (Polymer 15, 67.9% yield). Ion chromatography showed complete conversion to the acetate.

Preparation of Polymer 16: Poly[Dimethyl-2-(methacryloyloxy) Ethylsulfonium Chloride-co-N-(3-aminopropyl)methacrylamide Hydrochloride] (19:1 Molar Ratio)

A] Dimethyl-2-(methacryloyloxy) Ethylsulfonium Methylsulfate:

2-(Methylthio) ethylmethacrylate (30.00 g, 0.19 mol), dimethyl sulfate (22.70 g, 0.18 mol), and benzene (150 ml) were combined in a 250 ml round bottomed flask outfitted with a reflux condenser and a nitrogen inlet. The reaction solution was heated at reflux for 1.5 hours and allowed to stir at room temperature for 20 hours at which point the reaction had proceeded to about 95% yield by $^1H$ NMR. The solvent was removed by rotary evaporation to afford brownish oil that was stored as a 20 wt. % solution in dimethylformamide and used without further purification.

B] Poly[dimethyl-2-(methacryloyloxy) Ethylsulfonium methylsulfate-co-N-(3-aminopropyl)methacrylamide Hydrochloride] (19:1 Molar Ratio):

Dimethyl-2-(methacryloyloxy) ethylsulfonium methylsulfate (93.00 g of 20 wt. % solution in dimethylformamide, $6.40\times10^{-2}$ mol), N-(3-aminopropyl) methacrylamide hydrochloride (0.60 g, $3.36\times10^{-4}$ mol), and azobisisobutyronitrile (0.08 g, $4.87\times10^{-4}$ mol) were dissolved in methanol (100 ml) in a 250 ml round bottomed flask fitted with a septum. The solution was bubble degassed with nitrogen for 10 minutes and heated for 20 hours in a warm water bath at 55° C. The reaction was precipitated into ethyl acetate, redissolved in methanol, precipitated a second time into ethyl acetate, and dried under vacuum overnight. A white powder (15.0 g) was recovered (78.12% yield).

C] Poly[dimethyl-2-(metbacryloyloxy) Ethylsulfonium Chloride-co-N-(3-aminopropyl)methacrylamide Hydrochloride] (19:1 Molar Ratio):

The precursor polymer (2.13 g) from step B was dissolved in 100 ml of 4:1 methanol/water and passed through a flash column containing 300 $cm^3$ of DOWEX® 1×8–100 anion exchange resin using 4:1 methanol/water eluent. The recovered solvents were concentrated to about 30 ml and precipitated into 300 ml of methyl ethyl ketone. The damp, white powder collected was redissolved in 15 ml of water and stored in a refrigerator as a solution of Polymer 16 (10.60% solids).

Preparation of Polymer 17: Poly [Vinylbenzyldimethylsulfonium Methylsulfate]

A] Methyl(vinylbenzyl)sulfide:

Sodium methanethiolate (24.67 g, 0.35 mol) was combined with methanol (250 ml) in a 1 liter round bottomed flask outfitted with an addition funnel and a nitrogen inlet. Vinylbenzyl chloride (41.0 ml, 60:40 mixture of p and o isomers, 0.29 mol) in tetrahydrofuran (100 ml) was added via addition funnel over 30 minutes. The reaction mixture grew slightly warm and a milky suspension resulted. This was allowed to stir at room temperature for 20 hours at which point only a small amount of vinylbenzyl chloride was still evident by thin layer chromatography (2:1 hexanes/$CH_2Cl_2$ eluent). Another portion of sodium methanethiolate was added (5.25 g, $7.49\times10^{-2}$ mol) and after ten minutes, the reaction had proceeded to completion by thin layer chromatography. Diethyl ether (400 ml) was added and the resulting mixture was extracted twice with 600 ml of water and once with 600 ml of brine. The resulting organic extracts were dried over magnesium sulfate, a small amount (about 1 mg) of 3-t-butyl-4-hydroxy-5-methyl phenyl sulfide was added, and the solvents were stripped by rotary evaporation to afford a yellowish oil. Purification by vacuum distillation through a long Vigreux column yielded 43.35 g (91%) of the pure product as a clear liquid.

B] Dimethyl(vinylbenzyl)sulfonium Methylsulfate:

Methyl (vinylbenzyl) sulfide (13.59 g, $8.25\times10^{-2}$ mol), benzene (45 ml), and dimethyl sulfate (8.9 ml, $9.4\times10^{-2}$ mol) were combined in a 100 ml round bottomed flask equipped with a nitrogen inlet and allowed to stir at room temperature for 44 hours, at which point two layers were present. Water (20 ml) was added and the top (benzene) layer was removed by pipette. The aqueous layer was extracted three times with 30 ml of diethyl ether and a vigorous stream of nitrogen was bubbled through the solution to remove residual volatile compounds. The product was used without further purification as a 35% (w/w) solution.

C] Poly[dimethyl(vinylbenzyl)sulfonium Methylsulfate]:

All of the dimethyl (vinylbenzyl) sulfonium methylsulfate solution from the previous step (approximately $5.7\times10^{-2}$ mol) was combined with water (44 ml) and sodium persulfate (0.16 g, $6.72\times10^{-4}$ mol) in a 200 ml round bottomed flask fitted with a rubber septum. The reaction solution was bubble degassed with nitrogen for ten minutes and heated for 24 hours in a water bath at 50° C. As the solution did not appear viscous, additional sodium persulfate (0.16 g, $6.72\times10^{-4}$ mol) was added and the reaction was allowed to proceed for 18 more hours at 50° C. The solution was precipitated into acetone and immediately redissolved in water to give 100 ml of a solution of Polymer 17 (11.9% solids).

Preparation of Polymer 18: Poly [vinylbenzyldimethylsulfonium Chloride]

The aqueous product solution of Polymer 17 (16 ml, ~4.0 g solids) was precipitated into a solution of benzyltrimethylammonium chloride (56.0 g) in isopropanol (600 ml). The solvents were decanted and the solids were washed by stirring for 10 minutes in 600 ml of isopropanol and quickly dissolved in water to give 35 ml of a solution of Polymer 18

(11.1% solids). Analysis by ion chromatography showed>90% conversion to the chloride.

Synthesis of Poly(chloromethyl-ethylene Oxide-co-sodium Thiosulfate Methyl-ethylene Oxide) from Polymer: Polymers 19–21

Poly(epichlorohydrin) (Aldrich Chemical Company, $M_n$=700,000) (10 g) was dissolved in 250 ml of anhydrous dimethylsulfoxide (DMSO) and anhydrous sodium thiosulfate (17.0 g) was added. The mixture was heated at 65° C. for 24 hours. After cooling to room temperature, the hazy reaction mixture was dialyzed against water. A small amount of the resulting polymer (Polymer 19) solution was freeze dried for elemental analysis and the rest of the polymer solution was subject to imaging testing. Elemental analysis indicated the reaction conversion to sodium thiosulfate was 16 mol %.

In another reaction of the same scale, the reaction mixture was heated at 85° C. for 40 hours. Elemental analysis of the resulting polymer (Polymer 20) indicated the conversion to sodium thiosulfate was 26 mol %. When the reaction was carried out at 65° C. for 18 hours, the conversion to sodium thiosulfate was 13 mol % (Polymer 21).

Synthesis of Polymers 22 and 23

Synthesis of Poly(vinyl benzyl thiosulfate Sodium salt-co-methyl Methacylate) from Polymer: Polymer 22

Vinyl benzyl chloride (10 g, 0.066 mol), methyl methacrylate (15.35 g, 0.153 mol) and AIBN (0.72 g, 4 mmol) were dissolved 120 ml of toluene. The solution was purged with dry nitrogen and then heated at 65° C. overnight. After cooling to room temperature, the solution was dropwise added to 1200 ml of isopropanol. The resulting white powdery polymer was collected by filtration and dried under vacuum at 60° C. overnight. $^1$H NMR analysis indicate that the copolymer contained 44 mol % of vinyl benzyl chloride.

This polymer (16 g) was dissolved in 110 m of N,N'-dimethylformamide. To this solution was added sodium thiosulfate (12 g) and water (20 ml). Some polymer precipitated out. The cloudy reaction mixture was heated at 90° C. for 24 hours. After cooling to room temperature, the hazy reaction mixture was dialyzed against water. A small amount of the resulting polymer solution was freeze dried for elemental analysis and the rest of the polymer solution was subject to imaging testing. Elemental analysis indicated that all the vinyl benzyl chloride was converted to sodium thiosulfate salt.

Poly(vinyl benzyl thiosulfate sodium salt-co-styrene) (Polymer 23) can be similarly prepared.

Synthesis of Poly(vinyl Benzyl Thiosulfate Sodium Salt)from Polymer: Polymer 24

Vinyl benzyl chloride (21.5 g, 0.141 mol) and azobisisobutylronitrile (hereafter referred to as "AIBN") (0.25 g, 1.5 mmol) were dissolved in 50 ml of toluene. The solution was purged with dry nitrogen and then heated at 65° C. overnight. After cooling to room temperature, the solution was diluted to 100 ml and added dropwise to 1000 ml of isopropanol. The white powdery polymer was collected by filtration and dried under vacuum at 40° C. overnight.

This polymer (10 g) was dissolved in 150 ml of N,N'-dimethylformamide. To this solution was added sodium thiosulfate (10.44 g, 0.066 mol) and 30 ml of water. Some polymer precipitated out. The cloudy reaction mixture was heated at 95° C. for 12 hours. After cooling to room temperature, the hazy reaction mixture was dialyzed against water. A small amount of the resulting polymer solution was freeze dried for elemental analysis and the rest of the polymer solution was subject to imaging testing. Elemental analysis indicated the reaction conversion was 99 mol %.

Synthesis of poly[vinyl Benzyl Thiosulfate Sodium Salt-co-N-(3-aminopropyl) Methacrylamide Hydrochloride] from Monomer: Polymer 25

Vinyl benzyl chloride (20 g, 0.131 mol) was dissolved in 50 ml of ethanol in a 250 ml round-bottomed flask and placed in a 30° C. water bath. Sodium thiosulfate (18.8 g, 0.119 mol) was dissolved in 60 ml of 2:1 ethanol:water mixture, added to an addition funnel, and dripped into vinyl benzyl chloride solution over a period of 60 minutes. The reaction was stirred warm for additional 2 hours. Solvent was then evaporated and the white solid was dissolved in hot ethanol and hot filtered. White crystalline product was formed in the filtrate.

The resulting monomer (2 g, 8 mmol), 3-aminopropyl methacrylamide hydrochloride (0.16 g, 0.8 mmol), and 4,4'-azobis(4-cyanovaleric acid) (.75% in water, 30 mg) were added to a 25 ml round-bottomed flask. The solution was purged with dry nitrogen for 15 minutes and then heated at 60° C. overnight. After cooling to room temperature, the solution was dialyzed against water overnight. The resulting polymer was subject to characterization and imaging testing.

Synthesis of Poly(2-hydroxy-3-Sodium Thiosulfate-propyl Methacrylate-co-2-(methacryloyloxy)ethyl Acetoacetate) from Polymer: Polymer 26

Glycidyl methacrylate (20.8 g, 0.146 mol), (methacryloyloxy)ethyl acetoacetate (2.72 g, 0.013 mol), and AIBN (0.52 g) were dissolved in 110 ml of N,N'-dimethylformamide in a 250 ml round-bottomed flask capped with a rubber septum. The solution was purged with dry nitrogen for 15 minutes and then heated at 60° C. for 15 hours. The product was diluted with 20 ml of N,N'-dimethylformamide and purified by precipitated into 1200 ml of isopropanol. The resulting white powdery polymer was filtered and dried under vacuum at 40° C. overnight.

The above polymer (10 g) was dissolved in 150 ml of N,N'-dimethylformamide. To this solution was added sodium thiosulfate (11 g) and water (30 ml). Some polymer precipitated out. The cloudy reaction mixture was heated at 65° C. for 24 hours. After cooling to room temperature, the hazy reaction mixture was dialyzed against water. Small amount of the resulting polymer solution was freeze-dried for elemental analysis and the rest of the polymer solution was subject to imaging testing. Elemental analysis indicated complete conversion of glycidyl methacrylate to sodium thiosulfate salt.

Synthesis of Poly(2-sodium thiosulfate-ethyl Methacrylate): Polymer 27

2-Chloroethyl methacrylate (10 g, 0.067 mol) and AIBN (0.11 g, 0.7 mmol) were dissolved in 20 ml of tetrahydrofuran. The solution was purged with dry nitrogen and then heated at 60° C. for 17 hours. After cooling to room temperature, the solution was diluted to 80 ml and added dropwise to 800 ml of methanol. The resulting white powdery polymer was collected by filtration and dried under vacuum at 40° C. overnight.

The above polymer (5 g) was dissolved in 50 ml of N,N'-dimethylformamide. To this solution was added sodium thiosulfate (5.3 g) and water (10 ml). Some polymer precipitated out. The cloudy reaction mixture was heated at 90° C. for 52 hours. After cooling to room temperature, the reaction mixture was dialyzed against water. A small amount of the resulting polymer solution was freeze dried for. elemental analysis and the rest of the polymer solution was subject to imaging testing. Elemental analysis indicated that the conversion to sodium thiosulfate was 90 mol %.

Synthesis of Poly(4-aza-2-hydroxy-6-sodium Thiosulfatehexyl Methacrylate) from Monomer: Polymer 28

Sodium hydroxide (4.5 g 0.112 mol) and 2-aminoethanethio-sulfuric acid (8.85 g, 0.056 mol) were dissolved in 15 ml of water in a 100 ml round-bottomed flask and cooled in an ice bath. Glycidyl methacrylate (8 g, 0.056 mol) was dissolved in 15 ml of tetrahydrofuran and added slowly to the above solution, keeping the temperature below 25° C. The reaction was followed by thin layer chromatography. After the completion of the reaction, 4,4'-azobis(4-cyanovaleric acid) (75% in water, 0.52 g, 1.4 mmol) was added to the reaction flask. The flask was capped with a septum, purged with dry nitrogen for 15 minutes, and then heated at 60° C. for 17 hours. After cooling to room temperature, the solution was dialyzed against water overnight. The resulting polymer was subject to characterization and imaging testing.

Materials for the Examples

CAB-O-JET IJX 144 is an aqueous dispersion of carbon black (15 % pigment in water) developed by Cabot Laboratories. The carbon particle size is reported to be 220 nm. The dispersion is maintained by a surface modification technology wherein the surface of the carbon particles is functionalized with quaternary amine groups, providing surface positive charges that enable a stable dispersion in water. The dispersion can be prepared using the teaching of Johnson, IS & T's $50^{th}$ Annual Conference, Cambridge, Mass., May 18–23, 1997, pp. 310–312.

CAB-O-JET 200 is a commercially available aqueous dispersion of carbon black (20% pigment in water, Cabot Laboratories). The carbon particle size is reported to be 130 nm. The dispersion is maintained by a surface modification technology wherein the surface of the carbon particles is sulfonated, providing negative charges that enable a stable dispersion in water.

CAB-O-JET 300 is commercially available aqueous dispersion of carbon black (15% pigment in water, Cabot Laboratories). The carbon particle size is reported to be 150 nm. The dispersion is maintained by a surface modification technology wherein the surface of the carbon particles is carboxylated, providing negative charges that enable a stable dispersion in water.

Polymer grafted carbon dispersions in water (10% by weight, for example, FX-GEW-42) were obtained from Nippon Shokubai Co. (Osaka, Japan). The weight ratio of carbon black to grafted polymer in the dispersion is believed to be about 1:1. The grafted polymer includes polyethylene glycol, and the average carbon particle size is 130 nm.

Comparative Example 1

A heat-sensitive coating composition was prepared by dissolving 1.305 g of Polymer 14 in 23.4 g of water. A dispersion of carbon in water (0.87 g, 15% carbon by weight, CAB-O-JET IJX 144) was added. Using a 10× magnification loop one could see carbon particles soon after the addition, indicating that agglomeration had occurred. Methanol (2.6 g) was added to the mixture followed by bis(vinylsulfonyl)methane (BVSM, 1.812 g, 1.8% by weight in water). The composition was coated using a conventional coating apparatus to a wet thickness of 25.4 $\mu$m on both a gelatin-subbed polyethylene terephthalate support and mechanically grained and anodized aluminum support. The coatings were dried for four minutes at 70–80° C.

The resulting printing plates comprised a heat-sensitive layer containing crosslinked Polymer 14 (1.08 g/m$^2$) and carbon black (108 mg/m$^2$) on the supports. Agglomerated carbon was observed throughout the preparation of the composition and was obvious in heat-sensitive layers of the printing plates as well. Even when the mode of addition was reversed, the presence of agglomerated carbon was observed. That is, the carbon particles were readily dispersed and completely without agglomeration in water, but upon addition of Polymer 14, particulate carbon was observed throughout composition and plate preparation.

Even worse results were obtained when CAB-O-JET 200 carbon black was combined with Polymer 14. Instant agglomeration occurred and a carbon/polymer mass settled to the bottom of the container. Extensive milling with heavy metallic beads failed to disperse the carbon particles. It is believed that the agglomeration is caused by the interaction of the positively charged polymer and the negatively charged carbon.

Comparative Examples 2 & 3

Printing plates were prepared as described in Comparative Example 1 but using Polymers 17 and 18 in admixture with CAB-O-JET 200 carbon black dispersion. Similar unacceptable results were obtained.

Examples 1 and 2

Heat sensitive coating compositions of were prepared using Polymers 1 and 22 in a similar manner as described in Comparative Example 1. Four different carbon black dispersions were used in order to compare the solution compatibilities of cationically functionalized (CAB-O-JET IJX-144), anionically functionalized (CAB-O-JET 200 and 300) and polymer grafted carbon (FX-GEW-42) dispersions with Class III (anionic) and Class I (cationic) polymers. The results are shown in TABLE I below. Mixtures D and H in TABLE I represent compositions of the present invention (Examples 1 and 2). The other mixtures are outside the scope of this invention.

TABLE I

| MIX-TURE | POL-MER | CARBON | RESULTS |
|---|---|---|---|
| A | 22 | CAB-O-JET IJX-144 | Carbon immediately agglomerated and settled out. |
| B | 22 | CAB-O-JET 200 | Coating mixture appeared dispersed, but small particles could be resolved under a 10x loop upon coating |
| C | 22 | CAB-O-JET 300 | Coating mixture appeared dispersed, but small particles could be resolved under a 10x loop upon coating |
| D | 22 | FX-GEW-42 | Carbon well dispersed |
| E | 1 | CAB-O-JET IJX-144 | Particles were somewhat dispersed but could be resolved with a 10X loop. After 18 hours, the carbon had settled out. |

TABLE I-continued

| MIX-TURE | POL-MER | CARBON | RESULTS |
|---|---|---|---|
| F | 1 | CAB-O-JET 200 | Carbon immediately agglomerated and settled out. |
| G | 1 | CAB-O-JET 300 | Carbon immediately agglomerated and settled out. |
| H | 1 | FX-GEW-42 | Carbon well dispersed |

Both Polymers 1 and 22 showed complete solution incompatibility with carbons of the opposite charge. For mixtures A, F, and G, the carbon immediately agglomerated and settled to the bottom of the vials and coating these mixtures was impossible. Slightly better, but nonetheless unsatisfactory results were obtained when surface-functionalized carbons were mixed with polymers of the same charge. Mixture E produced an unstable dispersion that settled out over 10 18 hours and was also unsatisfactory for coating. Mixtures B and C appeared to be well dispersed, but upon coating, individual particles could be seen under a 10× loop magnification. In Examples 1 and 2, where polymer grafted carbon was used (mixtures D and H) satisfactory dispersions were obtained.

Example 3

A heat-sensitive coating composition was prepared by dissolving 1.305 g of Polymer 14 in 23.6 g of water. Polymer grafted carbon FX-GEW-42 (0.62 g, 10% carbon by weight in water) was added. With the aid of a 10× magnification loop one could see no evidence of agglomeration after the addition. Methanol (2.6 g) was added to the mixture followed by BVSM (1.812 g, 1.8% by weight in water). The composition was coated to a wet thickness of 25.4 $\mu$m onto both gelatin-subbed poly(ethylene terephthalate) support and mechanically grained and anodized aluminum support. The coatings were dried for four minutes at 70–80° C. The resulting printing plates had a heat-sensitive imaging layer containing crosslinked Polymer 15 (1.08 g/m$^2$) and polymer grafted carbon (54 mg/m$^2$). No evidence of carbon agglomeration (10× loop) was observed at any point during composition preparation, nor was any observed in the resulting printing plates.

Even after several days the composition used in the preparation of the plates was still well dispersed while the composition used in Comparative Example 1 had agglomerated to the point where the carbon had separated to the bottom of the vial.

Example 4

A heat sensitive coating composition was prepared by dissolving 0.870 g of Polymer 14 in 17.5 g of a 9:1 (by weight) water/methanol solvent mixture. Polymer grafted carbon FX-GEW-42 (0.414 g, 10 weight % carbon in water) was added followed by thorough mixing. BVSM (1.208 g, 1.8% by weight in water) was added and the composition was conventionally coated to a wet thickness of 25.4 $\mu$m on mechanically grained and anodized aluminum support. The composition was also coated to a wet coverage of 25.5 cm$^3$/m$^2$ on a gelatin-subbed Poly(ethylene terephthalate) support using a small automated hopper coating apparatus. All of the coatings were dried for four minutes at 70–80° C. The resulting printing plates comprised a heat-sensitive imaging layer containing crosslinked Polymer 14 (1.08 g/m$^2$) and polymer grafted carbon (54 mg/m$^2$) were provided on both supports.

Three additional heat-sensitive compositions were prepared in the same fashion but the amounts of FX-GEW-42 polymer grafted carbon was increased systematically. Printing plates were again prepared using both polyester and aluminum supports. The coverages of carbon black in the resulting heat-sensitive layers were 108, 162, and 216 mg/M$^2$, respectively.

No evidence of carbon agglomeration (using a 10× magnification loop) was observed either during composition preparation or in any of the printing plates. Even after several days of standing without agitation, the heat-sensitive composition used in the preparation of the plates remained well dispersed.

The specular transmission spectra of the coated heat-sensitive imaging layers on the printing plates having the polyester support were measured using a Perkin Elmer Lambda 12 spectrophotometer. The optical density of the series of coatings ranged from 0.1 to 0.6 at 830 nm affording very good absorption for laser exposure at 830 nm. The optical density of the series ranged from 0.1 to 0.5 at 1064 nm also affording very good absorption for laser exposure. By comparison a typical organic dye sensitizer that has high absorption at 830 nm would offer substantially no absorption at 1064 nm. Thus, the polymer grafted carbon used in the present invention offers advantage over organic dye sensitization because it absorbs light effectively over a range of wavelengths (800–1100 nm) at which commercial laser thermal platesetters operate.

The printing plates were imaged on a platesetter using a diode laser operating at a wavelength of 830 nm with an incident power of 356 mW. The plates were then mounted on a drum whose rotation speed was modified to provide for a series of images set at various exposures ranging from 360 to 900 mJ/cm$^2$.

Following imaging, the printing plates were mounted on a commercial A. B. Dick 9870 duplicator press and prints were made using VanSon Diamond Black ink and Universal Pink fountain solution containing PAR alcohol substitute (Vain Products Company, Inc.). All of the printing plates gave excellent negative printed images to at least 1000 impressions. The non-imaged areas of the plates did not wash off during printing, indicating that effective adhesion and cross-linking were attained in the plate formulation.

Example 5

A heat sensitive coating composition was prepared by dissolving 5.36 g of Polymer 14 in 81.8 g of methanol. Polymer grafted carbon FX-GE-003 (Nippon Shokubai, lot 971006, 5.36 g, 15 weight % carbon in ethanol) was added followed by complete mixing. BVSM (7.44 g, 1.8% by weight in water) was added and the composition was coated using a conventional coating apparatus (Model K202, RK Print-Coat Instruments Ltd.) to a wet thickness of 25.4 $\mu$m on a mechanically grained and anodized aluminum support. The composition was also coated to a wet coverage of 24.5 cc/m$^2$ on subbed polyethylene terephthalate support using a small automated hopper coating apparatus. Each of the coatings was dried in an oven for four minutes at 70–80° C. Thus, the resulting printing plates comprised a heat-sensitive imaging layer containing crosslinked Polymer 14 (1.08 g/m$^2$) and carbon black (162 mg/m$^2$) on both a polyester and aluminum support.

No evidence of carbon agglomeration (10× loop) was observed at any point during composition preparation, nor was agglomeration observed in any of the printing plates. Even after several days of standing without agitation, carbon black in the heat sensitive layers was still well dispersed.

The specular transmission spectra of the coated imaging layer on the polyester were measured in a Perkin Elmer Lambda 12 spectrophotometer. The optical density of the imaging layer was 0.63 at 830 nm, affording very good absorption for 830 nm laser exposure.

The printing plates were imaged on a plate setter using a diode laser operating at a wavelength of 830 nm with an incident power of 356 mW. The plates were then mounted on a drum whose rotation speed was modified to provide for a series of images set at various exposures ranging from 360 to 900 mJ/cm$^2$.

The plates were then mounted on a commercially available A. B. Dick 9870 duplicator press and printed images were made using VanSon Diamond Black ink and Universal Pink fountain solution containing PAR alcohol substitute (Varn Products Company, Inc.). All of the plates gave excellent negative printed images to at least 1000 impressions. The non-imaged areas of the plates did not wash off during printing, indicating that effective adhesion and crosslinking were attained during plate preparation.

The invention has been described in detail with particular reference to preferred embodiments thereof, but it will be understood that variations and modifications can be effected within the spirit and scope of the invention.

We claim:

1. A composition for thermal imaging comprising:

a) a hydrophilic heat-sensitive imaging ionomer which is a charged polymer having at least 20 mol. % of its recurring units negatively or positively charged, wherein the heat-sensitive ionomer is selected from the following three classes of polymers:

I) a crosslinked vinyl polymer comprisine recurring units comprising positivelv-charged, pendant N-alkylated aromatic heterocyclic groups, II) a crosslinked vinyl polymer comprising recurring organoonium groups, and III) a polymer comprising a pendant thiosulfate, b) polymer grafted carbon, and c) water or a water-miscible organic solvent.

2. The composition of claim 1 comprising water, methanol, ethanol, 1-methoxy-2-propanol, or a mixture of two or more of these.

3. The composition of claim 1 wherein said heat-sensitive ionomer is a Class I polymer represented by the Structure I:

(I)

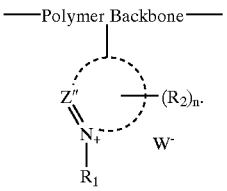

wherein $R_1$ is an alkyl group, $R_2$ is an alkyl group, an alkoxy group, an aryl group, an alkenyl group, halo, a cycloalkyl group, or a heterocyclic group having 5 to 8 atoms in the ring, Z" represents the carbon and nitrogen, oxygen, or sulfur atoms necessary to complete an aromatic N-heterocyclic ring having 5 to 10 atoms in the ring, n is 0 to 6, and $W^-$ is an anion.

4. The composition of claim 3 wherein $R_1$ is an alkyl group of 1 to 6 carbon atoms, $R_2$ is a methyl, ethyl or n-propyl group, Z" represents the carbon, nitrogen, oxygen, and sulfur atoms to complete a 5-membered ring, and n is 0 or 1.

5. The composition of claim 1 wherein said heat-sensitive ionomer is a Class I polymer represented by the Structure II:

II

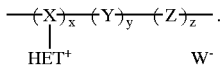

wherein $HET^+$ represents a positively-charged, pendant N-alkylated aromatic heterocyclic group, X represents recurring units having attached $HET^+$ groups, Y represents recurring units derived from ethylenically unsaturated polymerizable monomers that provide active crosslinking sites, Z represents recurring units for additional ethylenically unsaturated monomers, x is from about 20 to 100 mol %, y is from 0 to about 20 mol %, z is from 0 to about 80 mol %, and $W^-$ is an anion.

6. The composition of claim 5 wherein x is from about 30 to about 98 mol %, y is from about 2 to about 10 mol %, z is from 0 to about 68 mol %.

7. The composition of claim 5 wherein said positively-charged, pendant N-alkylated aromatic heterocyclic group is an imidazolium or pyridinium group.

8. The composition of claim 1 wherein said organoonium moiety is a pendant quaternary ammonium group on the backbone of said Class II polymer.

9. The composition of claim 1 wherein said heat-sensitive ionomer is a Class II vinyl polymer represented by either of Structures III, IV or V:

III

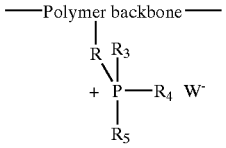

IV

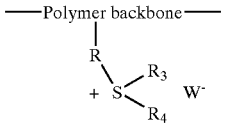

V

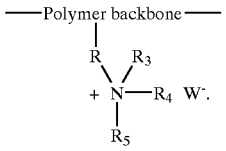

wherein R is an alkylene, arylene, or cycloalkylene group or a combination of two or more such groups, $R_3$, $R_4$ and $R_5$ are independently substituted or unsubstituted alkyl, aryl or cycloalkyl groups, or any two of $R_3$, $R_4$ and $R_5$ can be combined to form a heterocyclic ring with the charged phosphorus, nitrogen or sulfur atom, and $W^-$ is an anion.

10. The composition of claim 9 wherein R is an ethyleneoxycarbonyl or phenylenemethylene group, and $R_3$, $R_4$ and $R_5$ are independently a methyl or ethyl group, and $W^-$ is a halide or carboxylate.

11. The composition of claim 9 wherein said vinyl heat-sensitive polymer is a copolymer having recurring units derived from one or more additional ethylenically unsaturated polymerizable monomers, at least one of which monomers provides crosslinking sites.

12. The composition of claim 11 represented by the structure VI:

VI

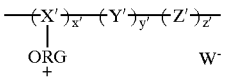

wherein ORG represents organoonium groups, X' represents recurring units to which the ORG groups are attached, Y' represents recurring units derived from ethylenically unsaturated polymerizable monomers that may provide active sites for crosslinking, Z' represents recurring units derived from any additional ethylenically unsaturated polymerizable monomers, x' is from about 20 to about 99 mol %, y' is from about 1 to about 20 mol %, and z' is from 0 to about 79 mol %.

13. The composition of claim 12 wherein x' is from about 30 to about 98 mol %, y' is from about 2 to about 10 mol % and z' is from 0 to about 68 mol %.

14. The composition of claim 1 wherein said heat-sensitive ionomer is a Class III polymer having the Structure VII:

VII

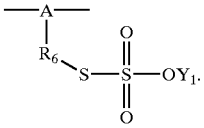

wherein A represents a polymeric backbone, $R_6$ is a divalent linking group, and $Y_1$ is a hydrogen or a cation.

15. The composition of claim 14 wherein $R_6$ is an alkylene group, an aralyne group, an arylenealkylene group, or $-(COO)_n(Z_1)_m$ wherein n is 0 or 1, and $Z_1$ is an alkylene group, an arylene group, or an arylenealkylene group, and $Y_1$ is hydrogen, ammonium ion or a metal ion.

16. The composition of claim 15 wherein $R_6$ is an alkylene group of 1 to 3 carbon atoms, an arylene of 6 carbon atoms in the aromatic ring, an arylenealkylene of 7 or 8 carbon atoms in the chain, or $—COOZ_1$ wherein $Z_1$ is methylene, ethylene or phenylene, and $Y_1$ is hydrogen, sodium or potassium.

17. The composition of claim 14 wherein said heat-sensitive polymer is a vinyl copolymer or vinyl ether copolymer.

18. The composition of claim 1 wherein said heat-sensitive polymer is present at from about 1 to about 10% solids, and said polymer grafted carbon is present at from about 0.1 to about 1% solids.

19. An imaging member comprising a support having disposed thereon a hydrophilic imaging layer prepared from the composition of claim 1.

20. The imaging member of claim 19 comprising a polyester or aluminum support.

21. The imaging member of claim 19 wherein said heat-sensitive ionomer is present in said imaging layer in an amount of at least 0.1 $g/m^2$, and said polymer grafted carbon is present in said imaging layer in an amount sufficient to provide a transmission optical density of at least 0.1 at 830 nm.

22. The imaging member of claim 19 wherein said support is an on-press printing cylinder.

23. A method of imaging comprising the steps of:

A) providing the imaging member of claim 19, and

B) imagewise exposing said imaging member to provide exposed and unexposed areas in the imaging layer of said imaging member, whereby said exposed areas are rendered more hydrophobic than said unexposed areas by heat provided by said imagewise exposure.

24. The method of claim 23 wherein said imagewise exposing is carried out using an IR radiation emitting laser, and said imaging member is a lithographic printing plate or imaging cylinder.

25. The method of claim 24 wherein said imagewise exposing is accomplished using a thermal head.

26. A method of printing comprising the steps of:

A) providing the imaging member of claim 19,

B) imagewise exposing said imaging member to provide exposed and unexposed areas in the imaging layer of said imaging member, whereby said exposed areas are rendered more hydrophobic than said unexposed areas by heat provided by said imagewise exposure, and C) contacting said imagewise exposed imaging member with a lithographic printing ink, and imagewise transferring said printing ink to a receiving material.

27. A method of imaging comprising the steps of:

A) spray coating the heat-sensitive composition of claim 1 onto a support to provide an imaging member, and B) imagewise exposing said imaging member to provide exposed and unexposed areas in the imaging layer of said imaging member, whereby said exposed areas are rendered more hydrophobic than said unexposed areas by heat provided by said imagewise exposure.

28. The method of claim 27 wherein said support is an on-press printing cylinder or sleeve.

29. A composition for thermal imaging comprising:

a) a hydrophilic heat-sensitive imaging ionomer selected from the following two classes of polymers:

I) a crosslinked vinyl polymer comprising recurring units comprising positively-charged, pendent N-alkylated aromatic heterocyclic groups, and II) a crosslinked polymer comprising recurring organoonium groups;

b) polymer grafted carbon; and c) water or a water-miscible organic solvent.

* * * * *

UNITED STATES PATENT AND TRADEMARK OFFICE

CERTIFICATE OF CORRECTION

PATENT NO. : 6,399,268 B1
DATED : June 4, 2002
INVENTOR(S) : Fleming et al.

It is certified that error appears in the above-identified patent and that said Letters Patent is hereby corrected as shown below:

Column 29,
Line 32, “comprisine” should read -- comprising --
Line 33, “positivelv-charged” should read -- positively charged --
Structure I, “—$(R_2)_n$•” should read -- —$(R_2)_n$ --

Column 30,
Structure II, “•” should be deleted
Line 8, “positively-charged” should read -- positively charged --
Line 20, “positively-” should read -- positively --

Column 31,
Line 32, “aralyne” should read -- arylene --
Line 47, “positively-charged” should read -- positively charged --; and “pendent” should read -- pendant --

Column 7,
Line 55, “an” should be deleted
Line 61, “unit,” should read -- units, --
Line 57, “a” should be deleted Column 8,
Line 1, “an” should be deleted
Lines 4 and 6, “a” should be deleted Column 17,
Line 29, “N,N-dimethylforamide” should read -- N,N-dimethylformamide --
Line 53, “eluent.” should read -- eluant. --

Column 19,
Lines 63 and 67, “eluent.” should read -- eluant. --

Column 20,
Lines 10 and 14, “eluent.” should read -- eluant. --

Column 21,
Lines 20 and 67, “eluent.” should read -- eluant. --

Column 22,
Line 19, “eluent” should read -- eluant --

Column 23,
Line 28, “Methacylate” should read -- Methacrylate --

UNITED STATES PATENT AND TRADEMARK OFFICE

CERTIFICATE OF CORRECTION

PATENT NO. : 6,399,268 B1
DATED : June 4, 2002
INVENTOR(S) : Fleming et al.

It is certified that error appears in the above-identified patent and that said Letters Patent is hereby corrected as shown below:

Column 23, cont'd,
Line 38, "indicate" should read -- indicated --
Lines 56-57, "azobisisobutylronitrile" should read -- azobisisobutyronitrile --

Column 25,
Line 5, "for." should read -- for --

Column 26,
Line 37, "of" should be deleted

Column 27,
Line 19, "10" should be deleted

Column 28,
Line 3, "was" should read -- were --
Line 6, "mg/$M^2$," should read -- mg/$m^2$, --

Signed and Sealed this

Twenty-eighth Day of January, 2003

JAMES E. ROGAN
*Director of the United States Patent and Trademark Office*